US010460587B2

(12) United States Patent
Ihara et al.

(10) Patent No.: US 10,460,587 B2
(45) Date of Patent: Oct. 29, 2019

(54) INFORMATION PROCESSING APPARATUS, INFORMATION PROCESSING METHOD, AND PROGRAM

(71) Applicant: SONY CORPORATION, Tokyo (JP)

(72) Inventors: Keigo Ihara, Tokyo (JP); Yasushi Miyajima, Tokyo (JP); Atsushi Shionozaki, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/745,931

(22) PCT Filed: May 18, 2016

(86) PCT No.: PCT/JP2016/064744
§ 371 (c)(1),
(2) Date: Jan. 18, 2018

(87) PCT Pub. No.: WO2017/026155
PCT Pub. Date: Feb. 16, 2017

(65) Prior Publication Data

US 2018/0211507 A1 Jul. 26, 2018

(30) Foreign Application Priority Data

Aug. 11, 2015 (JP) ..... 2015-158705

(51) Int. Cl.
*G08B 21/18* (2006.01)
*G08B 13/196* (2006.01)
(Continued)

(52) U.S. Cl.
CPC ..... *G08B 21/18* (2013.01); *G08B 13/181* (2013.01); *G08B 13/1966* (2013.01);
(Continued)

(58) Field of Classification Search
CPC ..... G05D 1/0272; G05D 1/028
(Continued)

(56) References Cited

U.S. PATENT DOCUMENTS

2007/0120871 A1 5/2007 Okamoto et al.
2007/0276540 A1* 11/2007 Okuda ..... G05D 1/0272 700/245

FOREIGN PATENT DOCUMENTS

JP 2000-224643 A 8/2000
JP 2004-208021 A 7/2004
(Continued)

OTHER PUBLICATIONS

International Search Report dated Jul. 26, 2016 in PCT/JP2016/064744, filed May 18, 2016.

*Primary Examiner* — Qutbuddin Ghulamali
(74) *Attorney, Agent, or Firm* — Xsensus LLP

(57) ABSTRACT

Radio wave information is observed in a predetermined environment. Information related to the radio wave is compared to new radio wave information. In a case where a result of the comparison satisfies a predetermined condition, a user is provided with a predetermined function. In an embodiment, positional information showing a position where the radio wave information is acquired and a time stamp is recorded for comparison, and in a case where the newly acquired radio wave information is radio wave information corresponding to a suspicious-person, a warning is issued to a user. In an embodiment, in a case where predetermined pieces of home radio wave information are not detected within a predetermined period, a system is operated to manage a house.

19 Claims, 32 Drawing Sheets

(51) Int. Cl.
*G08B 13/181* (2006.01)
*G08B 21/22* (2006.01)
*G08B 25/00* (2006.01)

(52) U.S. Cl.
CPC . *G08B 13/19669* (2013.01); *G08B 13/19673* (2013.01); *G08B 13/19682* (2013.01); *G08B 21/22* (2013.01); *G08B 25/008* (2013.01)

(58) Field of Classification Search
USPC ..... 340/600
See application file for complete search history.

(56) References Cited

FOREIGN PATENT DOCUMENTS

| | | | |
|---|---|---|---|
| JP | 2007-148904 | A | 6/2007 |
| JP | 2007-334868 | A | 12/2007 |
| JP | 2008-267741 | A | 11/2008 |
| JP | 2009-282888 | A | 12/2009 |
| JP | 2011-145839 | A | 7/2011 |
| JP | 2012-38165 | A | 2/2012 |
| JP | 2013-15916 | A | 1/2013 |
| JP | 2013-210848 | A | 10/2013 |
| JP | 2015-32133 | A | 2/2015 |
| WO | WO 2007/105295 | A1 | 9/2007 |

* cited by examiner

FIG. 3

DAILY RADIO WAVE INFORMATION DB

| RADIO WAVE INFORMATION DATA | POSITIONAL INFORMATION | TIME STAMP | . . . . |
|---|---|---|---|
| DATA 1 | NORTH LATITUDE: 35°41.1493'<br>EAST LONGITUDE: 139°45.3994' | 2015.5.1 09:00:00 | . . . . |
| DATA 2 | NORTH LATITUDE: 35°42.1500'<br>EAST LONGITUDE: 139°44.1358' | 2015.5.1 09:15:00 | . . . . |
| DATA 3 | NORTH LATITUDE: 35°35.1569'<br>EAST LONGITUDE: 139°43.9551' | 2015.5.1 09:30:00 | . . . . |
| DATA 4 | NORTH LATITUDE: 35°30.2487'<br>EAST LONGITUDE: 139°43.5423' | 2015.5.1 09:45:00 | . . . . |
| ⋮ | ⋮ | ⋮ | . . . . |

FIG. 4

SUSPICIOUS-PERSON RADIO WAVE INFORMATION CANDIDATE DB

| RADIO WAVE INFORMATION DATA | TIME STAMP AT FIRST DETECTION | TIME STAMP AT DETECTION | POSITIONAL INFORMATION | NUMBER OF TIMES OF DETECTION | EVALUATION VALUE | . . . |
|---|---|---|---|---|---|---|
| DATA a | 2015.4.1 09:00:00 | 2015.4.1 09:00:00 | NORTH LATITUDE: 35°41.1493'<br>EAST LONGITUDE: 139°45.3994' | 1 | 1 | . . . |
| DATA b | 2015.4.3 10:15:00 | 2015.4.5 09:15:00 | NORTH LATITUDE: 35°42.1500'<br>EAST LONGITUDE: 139°44.1358' | 3 | 2 | . . . |
| | | . . . | . . . | | | |
| DATA c | 2015.4.5 10:30:00 | 2015.4.7 09:30:00 | NORTH LATITUDE: 35°35.1569'<br>EAST LONGITUDE: 139°43.9551' | 10 | 3 | . . . |
| | | . . . | . . . | | | |
| DATA d | 2015.4.7 11:45:00 | 2015.4.9 09:45:00 | NORTH LATITUDE: 35°30.2487'<br>EAST LONGITUDE: 139°43.5423' | 15 | 3 | . . . |
| | | . . . | . . . | | | |
| . . . | . . . | . . . | . . . | . . . | . . . | . . . |

FIG. 5

SUSPICIOUS-PERSON RADIO WAVE INFORMATION DB

| RADIO WAVE INFORMATION DATA | TIME STAMP AT FIRST DETECTION | TIME STAMP AT DETECTION | POSITIONAL INFORMATION | NUMBER OF TIMES OF DETECTION | RISK LEVEL | ・・・ |
|---|---|---|---|---|---|---|
| DATA A | 2015.4.2 09:00:00 | 2015.4.2 09:00:00 | NORTH LATITUDE: 35°41.1493'<br>EAST LONGITUDE: 139°45.3994' | 1 | 1 | ・・・ |
| DATA B | 2015.4.4 10:15:00 | 2015.4.6 09:15:00 | NORTH LATITUDE: 35°42.1500'<br>EAST LONGITUDE: 139°44.1358' | 3 | 2 | ・・・ |
| | | ・<br>・<br>・ | ・<br>・<br>・ | | | |
| DATA C | 2015.4.6 10:30:00 | 2015.4.8 09:30:00 | NORTH LATITUDE: 35°35.1569'<br>EAST LONGITUDE: 139°43.9551' | 10 | 3 | ・・・ |
| | | ・<br>・<br>・ | ・<br>・<br>・ | | | |
| DATA D | 2015.4.8 11:45:00 | 2015.4.9 09:45:00 | NORTH LATITUDE: 35°30.2487'<br>EAST LONGITUDE: 139°43.5423' | 15 | 3 | ・・・ |
| | | ・<br>・<br>・ | ・<br>・<br>・ | | | |
| ・<br>・<br>・<br>・ | ・<br>・<br>・<br>・ | ・<br>・<br>・<br>・ | ・<br>・<br>・<br>・ | ・<br>・<br>・<br>・ | ・<br>・<br>・<br>・ | ・・・ |

FIG. 12

ASSOCIATION DB

| SURVEILLANCE CAMERA ID | CORRESPONDING RADIO WAVE MONITOR NODE ID |
|---|---|
| AAAA | 1111 |
| BBBB | 2222 |
| CCCC | 3333 |
| ⋮ | ⋮ |

FIG. 13

RADIO WAVE INFORMATION DB

| RADIO WAVE INFORMATION DATA | RADIO WAVE MONITOR NODE ID | TIME STAMP | ・・・・ |
|---|---|---|---|
| DATA 1 | 1111 | 2015.5.1 00:00:00 | ・・・・ |
| DATA 2 | 2222 | 2015.5.1 00:00:00 | ・・・・ |
| DATA 3 | 3333 | 2015.5.1 00:00:00 | ・・・・ |
| DATA 4 | 1111 | 2015.5.1 00:05:00 | ・・・・ |
| ・<br>・<br>・<br>・ | ・<br>・<br>・<br>・ | ・<br>・<br>・<br>・ | ・・・・ |

FIG. 14

CAPTURED IMAGE DB

| CAPTURED IMAGE DATA | SURVEILLANCE CAMERA ID | TIME STAMP | ・・・・ |
|---|---|---|---|
| DATA 1 | AAAA | 2015.5.1 00:00:00 | ・・・・ |
| DATA 2 | BBBB | 2015.5.1 00:00:00 | ・・・・ |
| DATA 3 | CCCC | 2015.5.1 00:00:00 | ・・・・ |
| DATA 4 | AAAA | 2015.5.1 00:05:00 | ・・・・ |
| ・<br>・<br>・<br>・ | ・<br>・<br>・<br>・ | ・<br>・<br>・<br>・ | ・・・・ |

FIG. 23

HOME TERMINAL DB

| TERMINAL ID | RADIO WAVE INFORMATION | TIME STAMP AT REGISTRATION | TIME STAMP AT PREVIOUS DETECTION | OPERATION STATUS | . . . . |
|---|---|---|---|---|---|
| AAAA | DATA A | 2015.3.1 09:15:00 | 2015.5.2 11.00:00 | Y | . . . . |
| BBBB | DATA B | 2015.3.1 12:00:00 | 2015.5.2 11:00:00 | Y | . . . . |
| CCCC | DATA C | 2015.4.1 13:00:00 | 2015.5.1 23:00:00 | N | . . . . |
| DDDD | DATA D | 2015.4.1 14:05:00 | 2015.5.1 21:00:00 | N | . . . . |
| ⋮ | ⋮ | ⋮ | ⋮ | ⋮ | . . . . |

FIG. 24

HOME TERMINAL CANDIDATE DB

| TERMINAL ID | RADIO WAVE INFORMATION | TIME STAMP AT FIRST DETECTION | TIME STAMP AT PREVIOUS DETECTION | NUMBER OF TIMES OF DETECTION | · · · · |
|---|---|---|---|---|---|
| 1111 | DATA 1 | 2015.5.1 09:15:00 | 2015.5.2 12:00:00 | 10 | · · · · |
| 2222 | DATA 2 | 2015.5.1 12:00:00 | 2015.5.1 12:00:00 | 1 | · · · · |
| 3333 | DATA 3 | 2015.5.1 13:00:00 | 2015.5.1 13:00:00 | 1 | · · · · |
| 4444 | DATA 4 | 2015.5.1 14:05:00 | 2015.5.1 21:00:00 | 3 | · · · · |
| ⋮ | ⋮ | ⋮ | ⋮ | ⋮ | · · · · |

INFORMATION PROCESSING APPARATUS, INFORMATION PROCESSING METHOD, AND PROGRAM

TECHNICAL FIELD

The present disclosure relates to an information processing apparatus, an information processing method, and a program.

BACKGROUND ART

The development of information communication technologies has brought a situation in which countless radio waves exist in the surroundings. Mobile phone terminals that learn a moving path of a user utilizing identification information (ID information) of a base station that is sent from a wireless base station for mobile phone terminals among such countless radio waves have been proposed (for example, see Patent Literature 1 below).

CITATION LIST

Patent Literature

Patent Literature 1: JP 2000-224643A

DISCLOSURE OF INVENTION

Technical Problem

However, the technology disclosed in Patent Literature 1 above merely utilizes ID information emitted from a radio wave source installed at a specific position, that is, a wireless base station for mobile phone terminals, and merely utilizes some limited radio waves among radio waves existing countlessly in the surroundings, which cannot be utilized at a place where no wireless base station exists.

Thus, a technology capable of effectively utilizing radio waves existing countlessly in the surroundings to further improve user convenience is pursued under the current circumstances.

Therefore, in light of the above circumstances, the present disclosure proposes an information processing apparatus, an information processing method, and a program capable of utilizing radio waves existing in the surroundings to further improve user convenience.

Solution to Problem

According to the present disclosure, there is provided an information processing apparatus including: a control unit configured to control processing of recording radio wave information concerning a radio wave observed in a predetermined environment and related information related to the radio wave information in association with each other, comparing the newly acquired radio wave information and the recorded radio wave information, and in a case where a result of comparison satisfies a predetermined condition, providing a user with a predetermined function on a basis of related information related to the newly acquired radio wave information.

In addition, according to the present disclosure, there is provided an information processing method including: controlling processing of recording radio wave information concerning a radio wave observed in a predetermined environment and related information related to the radio wave information in association with each other, comparing the newly acquired radio wave information and the recorded radio wave information, and in a case where a result of comparison satisfies a predetermined condition, providing a user with a predetermined function on a basis of related information related to the newly acquired radio wave information.

In addition, according to the present disclosure, there is provided a program for causing a computer to achieve a function of controlling processing of recording radio wave information concerning a radio wave observed in a predetermined environment and related information related to the radio wave information in association with each other, comparing the newly acquired radio wave information and the recorded radio wave information, and in a case where a result of comparison satisfies a predetermined condition, providing a user with a predetermined function on a basis of related information related to the newly acquired radio wave information.

According to the present disclosure, processing of recording radio wave information concerning a radio wave observed in a predetermined environment and related information related to the radio wave information in association with each other, comparing the newly acquired radio wave information and the recorded radio wave information, and in a case where a result of comparison satisfies a predetermined condition, providing a user with a predetermined function on a basis of related information related to the newly acquired radio wave information is controlled.

Advantageous Effects of Invention

As described above, according to the present disclosure, it is possible to utilize radio waves existing in the surroundings to further improve user convenience.

Note that the effects described above are not necessarily limitative. With or in the place of the above effects, there may be achieved any one of the effects described in this specification or other effects that may be grasped from this specification.

BRIEF DESCRIPTION OF DRAWINGS

FIG. 3 is an explanatory diagram showing an example of a data structure of a range-of-activity radio wave information database for use in an information processing apparatus according to a first embodiment of the present disclosure.

FIG. 4 is an explanatory diagram showing an example of a data structure of a suspicious-person radio wave information candidate database for use in the information processing apparatus according to the embodiment.

FIG. 5 is an explanatory diagram showing an example of a data structure of a suspicious-person radio wave information database for use in the information processing apparatus according to the embodiment.

FIG. 12 is an explanatory diagram showing an example of a data structure of an association database for use in the information processing apparatus according to the embodiment.

FIG. 13 is an explanatory diagram showing an example of a data structure of a radio wave information database for use in the information processing apparatus according to the embodiment.

FIG. 14 is an explanatory diagram showing an example of a data structure of a captured image database for use in the information processing apparatus according to the embodiment.

FIG. 23 is an explanatory diagram showing an example of a data structure of a home terminal database for use in the information processing apparatus according to the embodiment.

FIG. 24 is an explanatory diagram showing an example of a data structure of a home terminal candidate database for use in the information processing apparatus according to the embodiment.

MODE(S) FOR CARRYING OUT THE INVENTION

Figure 1:
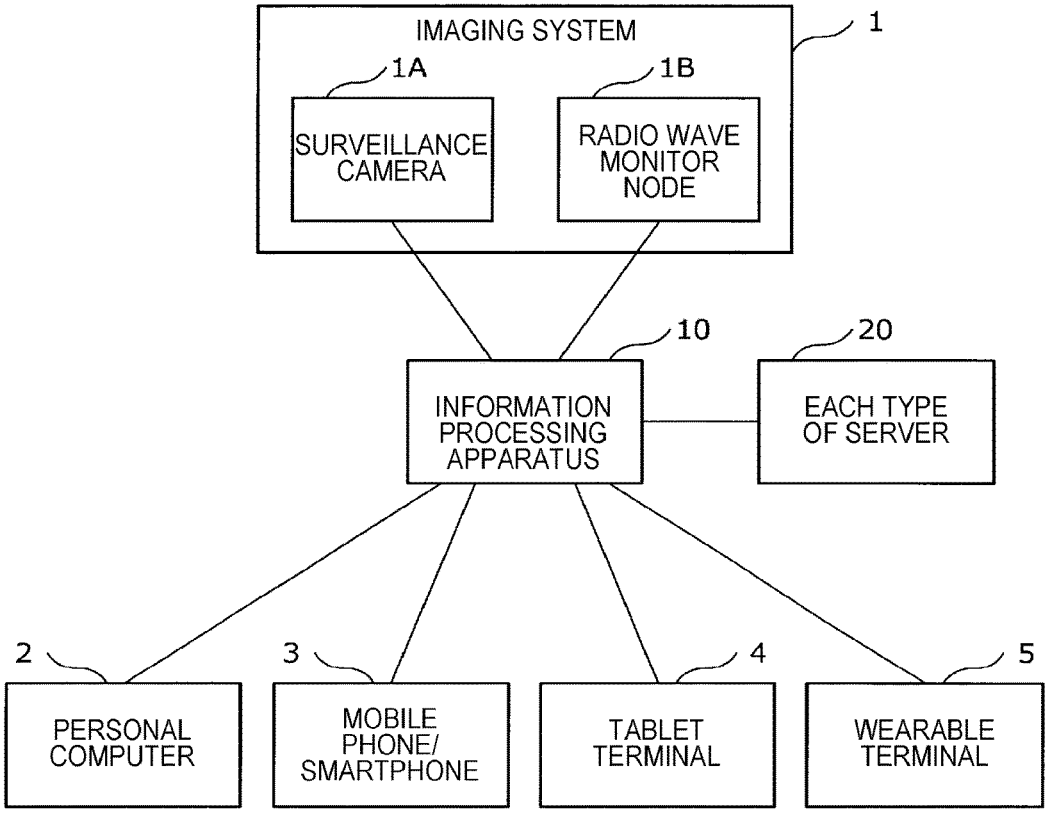
FIG. 1 is an explanatory diagram for describing an information processing apparatus according to each embodiment of the present disclosure.

Hereinafter, (a) preferred embodiment(s) of the present disclosure will be described in detail with reference to the appended drawings. Note that, in this specification and the appended drawings, structural elements that have substantially the same function and structure are denoted with the same reference numerals, and repeated explanation of these structural elements is omitted.

Note that description will be provided in the following order.

1. Regarding information processing apparatus
1.1. Regarding relationship between information processing apparatus and another appliance
1.2. Regarding configuration of information processing apparatus
2. First embodiment (suspicious-person specifying processing through use of radio wave information)
2.1. Regarding suspicious-person specifying processing by means of radio wave information
2.2. Regarding radio-wave-information analyzing processing
2.3. Regarding flow of information processing method
3. Second embodiment (surveillance-camera-captured-image extracting processing through use of radio wave information)
3.1. Regarding surveillance-camera-captured-image extracting processing by means of radio wave information
3.2. Regarding radio-wave-information analyzing processing
3.3. Regarding flow of information processing method
4. Third embodiment (house management processing through use of radio wave information)
4.1. Regarding house management processing by means of radio wave information
4.2. Regarding radio-wave-information analyzing processing
4.3. Regarding flow of information processing method (Regarding Information Processing Apparatus)

An information processing apparatus according to each embodiment of the present disclosure will be described below in detail.

<Regarding Relationship Between Information Processing Apparatus and Another Appliance>

First, with reference to FIG. 1, a relationship between the information processing apparatus according to each embodiment of the present disclosure and another appliance will be briefly described. FIG. 1 is an explanatory diagram for describing the information processing apparatus according to each embodiment of the present disclosure.

An information processing apparatus 10 according to each embodiment of the present disclosure acquires radio wave information concerning radio waves existing around the information processing apparatus 10, and analyzes the obtained radio wave information. Accordingly, the information processing apparatus 10 according to each embodiment of the present disclosure can learn about radio waves existing around the information processing apparatus 10. Thereafter, the information processing apparatus 10 according to each embodiment of the present disclosure controls function providing processing of particularly paying attention to radio wave information that satisfies a predetermined condition as a result of analysis (learning), and on the basis of the predetermined radio wave information, providing a user with a predetermined function.

The information processing apparatus 10 having such a function may be a stationary appliance situated at a certain place, or may be a mobile appliance that can be held and carried by a user or the like, for example.

An emission source of radio wave information that this information processing apparatus 10 acquires can include the imaging system 1 including a surveillance camera 1A and a radio wave monitor node 1B, each type of personal computer 2 of a desktop type, a notebook type, or the like, each type of mobile phone or smartphone 3, each type of tablet terminal 4, each type of wearable terminal 5, and the like, as shown in FIG. 1, for example. In addition, besides these appliances, publicly-known electrical appliances, such as various types of AV equipment including a mobile music player and the like and a mobile game console, can be included. These electrical appliances serving as emission sources of radio wave information can be regarded as terminals that emit predetermined radio waves.

Here, radio wave information that the information processing apparatus 10 acquires from various terminals as described above includes various types of information concerning various radio waves (for example, radio waves for use in various types of wireless communication including wireless LAN communication or the like, such as Wi-Fi or Bluetooth (registered trademark)) that the information processing apparatus 10, the radio wave monitor node connected to the information processing apparatus 10, or the like has observed. In such radio wave information, for example, various feature values (for example, identification information such as a MAC address which is information specific to the detected radio wave, the electric field intensity, and the like) that characterize a detected radio wave have been described.

In addition, besides radio wave information as described above, the information processing apparatus 10 is also capable of utilizing as necessary various types of information that various terminals as described above acquire or generate.

Furthermore, the information processing apparatus 10 is capable of performing radio-wave-information analyzing processing and implementing predetermined function providing processing in cooperation with each type of server 20 connected mutually via each type of network such as the Internet. For example, the information processing apparatus 10 is capable of utilizing various types of user information or the like included in a social network or the like that each type of server 20 implements, utilizing various types of information held by each type of server 20, and performing various arithmetic operations utilizing these various types of information to secondarily generate various types of data.

Note that FIG. 1 illustrates as if the information processing apparatus 10 is an appliance different from the various terminals shown in FIG. 1, whilst it is needless to say that functions of the information processing apparatus 10 according to the present embodiment may be implemented in the various terminals shown in FIG. 1.

<Regarding Configuration of Information Processing Apparatus>

Figure 2A:
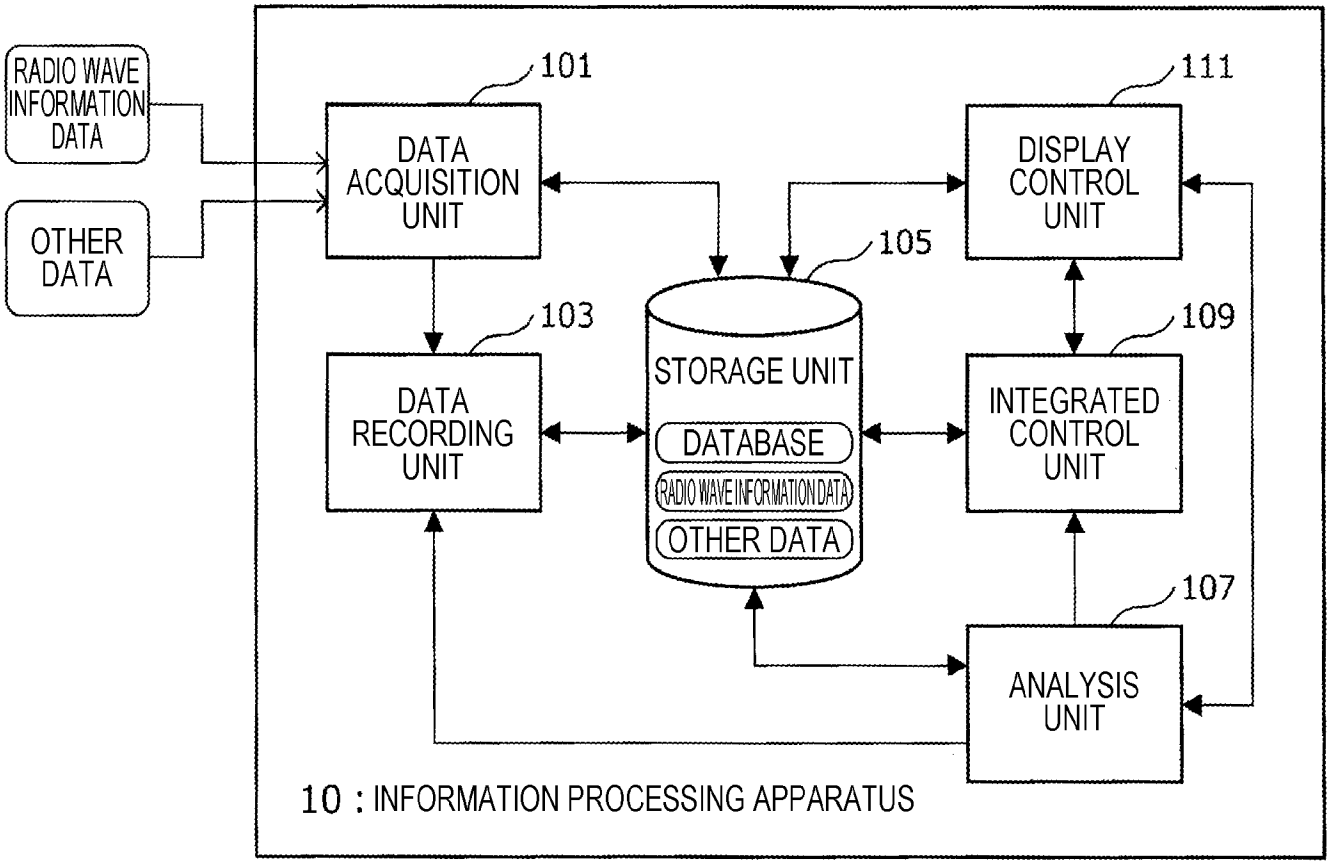
FIG. 2A is a block diagram showing an example of a configuration of the information processing apparatus according to each embodiment of the present disclosure.
Figure 2B:
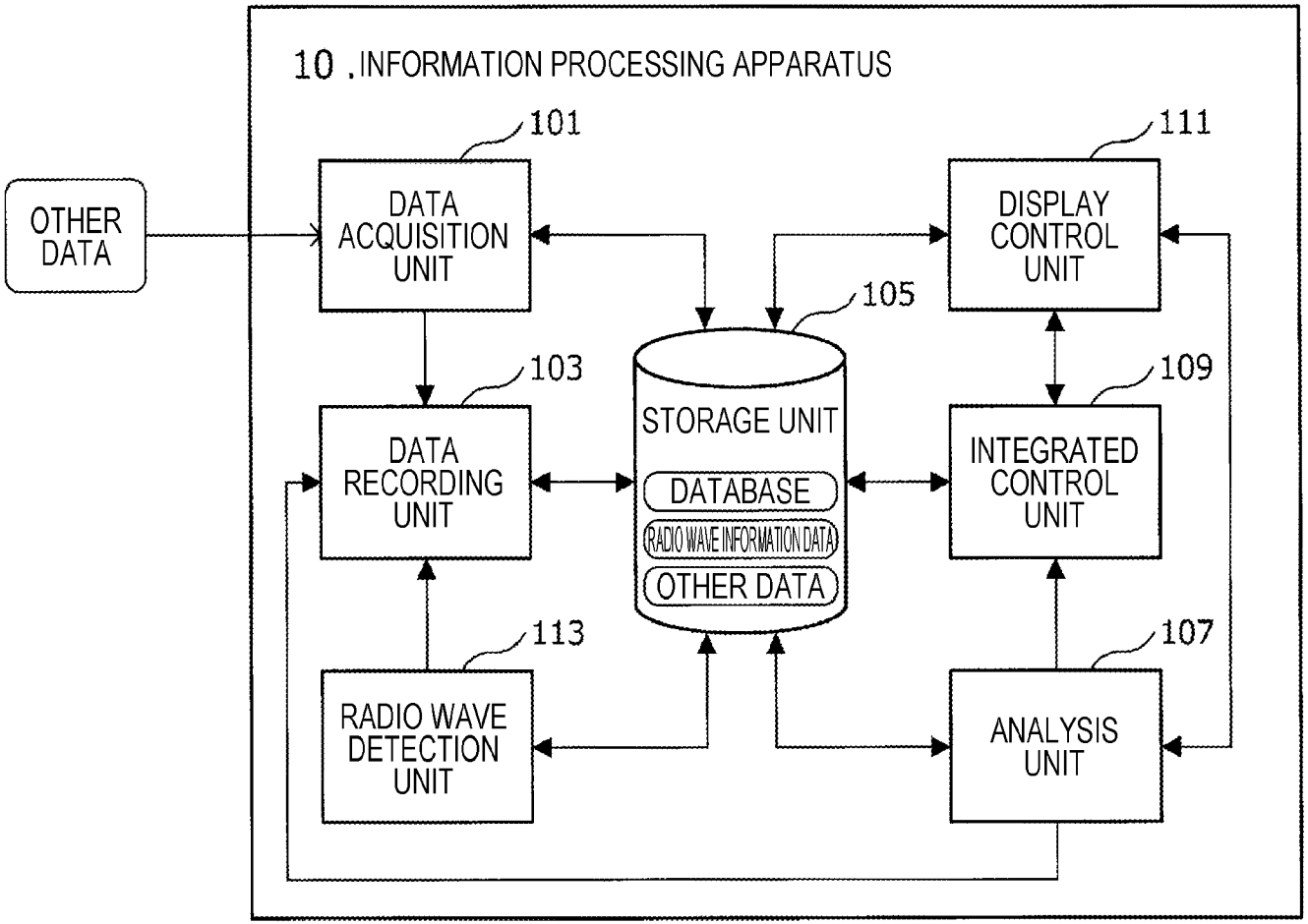
FIG. 2B is a block diagram showing an example of a configuration of the information processing apparatus according to each embodiment of the present disclosure.

Next, a configuration of the information processing apparatus 10 according to an embodiment of the present disclosure will be described in detail with reference to FIG. 2A and FIG. 2B. FIG. 2A and FIG. 2B are block diagrams each schematically showing an example of a configuration of the information processing apparatus 10 according to an embodiment of the present disclosure.

The information processing apparatus 10 according to each embodiment of the present disclosure mainly includes a data acquisition unit 101, a data recording unit 103, a storage unit 105, an analysis unit 107, an integrated control unit 109, and a display control unit 111, as shown in FIG. 2A.

Note that description will be made below referring, as an example, to a case where the information processing apparatus 10 according to each embodiment of the present disclosure has inside a storage device that stores data regarding radio wave information (radio wave information data) and other data, whilst it is needless to say that the storage device that stores these pieces of data may be provided outside the information processing apparatus 10. In addition, the data acquisition unit 101, the data recording unit 103, the storage unit 105, the analysis unit 107, the integrated control unit 109, and the display control unit 111 which will be described below in detail are provided in a manner distributed to a plurality of information processing apparatuses existing on various networks such as the Internet, and the plurality of information processing apparatuses may cooperate with one another to implement the functions of the information processing apparatus 10 according to the present embodiment.

The data acquisition unit 101 is implemented by a central processing unit (CPU), a read only memory (ROM), a random access memory (RAM), a communication device, or the like, for example. The data acquisition unit 101 acquires radio wave information and a time stamp sent from various terminals as shown in FIG. 1. In addition, the data acquisition unit 101 acquires other data such as positional information and data concerning a captured image, for example, and a time stamp from various terminals as shown in FIG. 1. That is, the data acquisition unit 101 functions as a communication unit that implements communication between the information processing apparatus 10 and each of various terminals as shown in FIG. 1. In addition, the radio wave information data and the time stamp as well as the other data and the time stamp having been acquired are transmitted to the data recording unit 103 which will be described later.

The data recording unit 103 is implemented by a CPU, a ROM, a RAM, or the like, for example. The data recording unit 103 correlates the radio wave information data and the time stamp transmitted from the data acquisition unit 101 with each other, and then stores the radio wave information data and the time stamp at a predetermined place in the storage unit 105 which will be described later. In addition, the data recording unit 103 correlates the other data and the time stamp transmitted from the data acquisition unit 101 with each other, and then stores the other data and the time stamp at a predetermined place in the storage unit 105 which will be described later. Accordingly, in the storage unit 105 which will be described later, radio wave information data and other data output at any time from various terminals are accumulated.

The storage unit 105 is implemented by the RAM, the storage device, or the like, for example, that the information processing apparatus 10 according to the present embodiment includes. Various parameters, progress of processing, and the like needed to be saved when the information processing apparatus 10 according to the present embodiment performs some processing, or various databases, programs, and the like are recorded in the storage unit 105 as necessary. In particular, in this storage unit 105, radio wave information which is information concerning radio waves observed in a predetermined environment is recorded as a database in association with related information related to the radio wave information. In the storage unit 105 having such various types of information stored therein, the data acquisition unit 101, the data recording unit 103, the analysis unit 107, the integrated control unit 109, the display control unit 111, and the like are capable of freely performing data reading/writing processing.

The analysis unit 107 is implemented by a CPU, a ROM, a RAM, or the like, for example. The analysis unit 107 analyzes radio wave information newly acquired by the data acquisition unit 101 of the information processing apparatus 10, and newly adds the newly acquired radio wave information that satisfies a predetermined condition to the above-described database in association with related information related to the radio wave information.

Note that specific processing carried out in the analysis unit 107 will be described again in detail in accordance with the contents of specific services (functions) provided by the information processing apparatus 10 according to each embodiment below.

The integrated control unit 109 is implemented by a CPU, a ROM, a RAM, or the like, for example. The integrated control unit 109 controls function providing processing of providing a user with a predetermined function on the basis of radio wave information recorded in a database stored in the storage unit 105 or the like.

Note that specific processing carried out in the integrated control unit 109 will be described again in detail in accordance with the contents of specific services (functions) provided by the information processing apparatus 10 according to each embodiment below.

The display control unit 111 is implemented by a CPU, a ROM, a RAM, an output device, a communication device, or the like, for example. The display control unit 111 performs display control when causing various types of information generated by the analysis unit 107 and the integrated control unit 109 functioning to be displayed on an output device such as a display that the information processing apparatus 10 includes, an output device provided outside the information processing apparatus 10, or the like. In addition, the display control unit 111 also carries out display control when causing various types of display screen to be used when a user performs various input operations on the information processing apparatus 10 to be displayed on a predetermined output device or the like. This allows the user of the information processing apparatus 10 to view desired information on the spot.

Note that, in the configuration of the information processing apparatus 10 shown in FIG. 2A, the information processing apparatus 10 utilizes radio wave information detected by various terminals provided outside the information processing apparatus 10 or a radio wave monitor node not shown (a terminal capable of detecting radio waves). However, the information processing apparatus 10 according to each embodiment of the present disclosure may further have a radio wave detection unit 113 as shown in FIG. 2B, for example, in addition to the respective processing units shown in FIG. 2A.

The radio wave detection unit 113 is implemented by a CPU, a ROM, a RAM, a communication device, a radio wave sensor, or the like, for example. In addition, the radio wave detection unit 113 may be an appliance such as a radio wave monitor node included in or connected to the information processing apparatus 10. The radio wave detection unit 113 detects various radio waves emitted from various terminals as shown in FIG. 1, and generates radio wave information in which various feature values that characterize the detected radio waves have been described. Upon generating radio wave information as described above, the radio wave detection unit 113 outputs the generated radio wave information to the data recording unit 103. In addition, the radio wave detection unit 113 outputs the detected radio wave information regarding various terminals to the data recording unit 103 in association with a time stamp.

The fact that the information processing apparatus 10 according to each embodiment of the present disclosure further has the radio wave detection unit 113 allows the information processing apparatus 10 itself to acquire various types of radio wave information.

The above illustrates an example of the functions of the information processing apparatus 10 according to each embodiment of the present embodiment. Each of the above structural elements may be realized using general-purpose members or circuits, but may also be realized using hardware specialized in the function of each structural element. In addition, the functions of each of the structural elements may also be conducted entirely by a CPU or the like. Consequently, it is possible to appropriately modify the configuration to be used according to the technical level at the time of carrying out the each embodiment of the present disclosure.

Note that it is also possible to create a computer program for realizing the respective functions of the information processing apparatus according to each embodiment of the present disclosure as discussed above, and implement the computer program in a personal computer or the like. In addition, a computer-readable recording medium having such a computer program stored therein can also be provided. The recording medium is a magnetic disk, an optical disc, a magneto-optical disc, a flash memory, or the like, for example. Furthermore, the above computer program may also be delivered via a network, for example, without using a recording medium.

(First Embodiment)

An information processing apparatus according to a first embodiment of the present disclosure will be described below in detail with reference to FIG. 3 to FIG. 9B.

Figure 6:
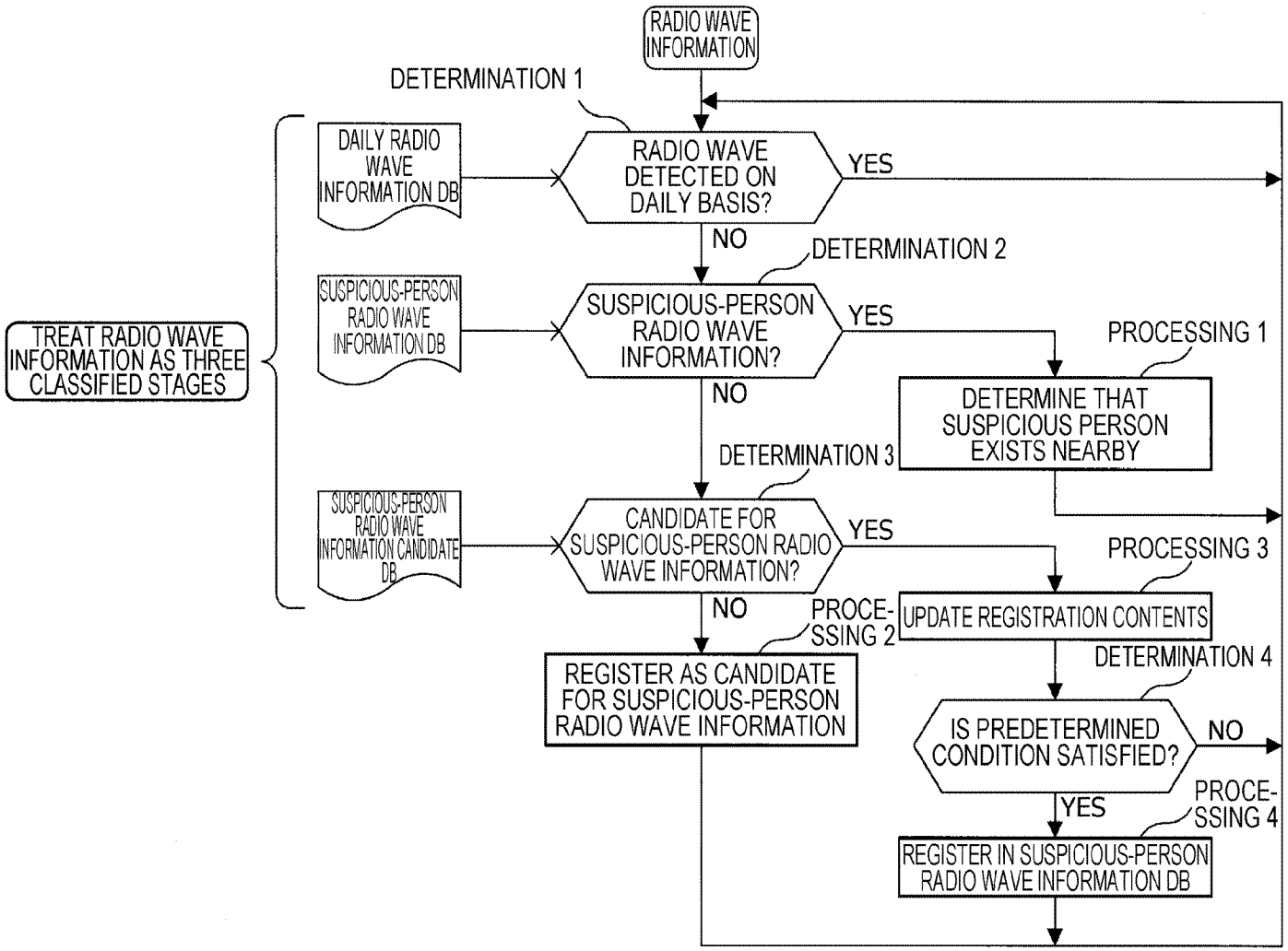
FIG. 6 is a flowchart for describing radio-wave-information analyzing processing carried out in the information processing apparatus according to the embodiment.

FIG. 3 is an explanatory diagram showing an example of a data structure of a range-of-activity radio wave information database for use in the information processing apparatus according to the first embodiment of the present disclosure. FIG. 4 is an explanatory diagram showing an example of a data structure of a suspicious-person radio wave information candidate database for use in the information processing apparatus according to the present embodiment. FIG. 5 is an explanatory diagram showing an example of a data structure of a suspicious-person radio wave information database for use in the information processing apparatus according to the present embodiment. FIG. 6 is a flowchart for describing radio-wave-information analyzing processing carried out in the information processing apparatus according to the present embodiment. FIG. 7 to FIG. 9B are explanatory diagrams each schematically showing an example of a display screen of the information processing apparatus according to the present embodiment.

<Regarding Suspicious-person Specifying Processing by Means of Radio Wave Information>

The information processing apparatus 10 according to the present embodiment has a configuration as shown in FIG. 2A or FIG. 2B, and is implemented as a portable device that can be held by a user and carried with the user himself/herself. On this occasion, some functions (for example, functions or the like of the data acquisition unit 101, the data recording unit 103, the display control unit 111, and the radio wave detection unit 113) of the information processing apparatus 10 according to the present embodiment may be implemented as a portable device, and the remaining functions (for example, functions or the like of the storage unit 105, the analysis unit 107, and the integrated control unit 109) may be implemented in a server or the like capable of making mutual communication with the portable device. In addition, the information processing apparatus 10 according to the present embodiment may be implemented as a function of a portable terminal, such as a mobile phone, a smartphone, a notebook computer, a tablet terminal, or a wearable terminal, for example.

In the information processing apparatus 10 according to the present embodiment, attention is focused on radio waves emitted around an electronic appliance or a communication appliance held by a user. Then, by being held by the user, the information processing apparatus 10 according to the present embodiment learns about each type of radio wave existing around the information processing apparatus 10 (that is, around the user) upon correlating with positional information concerning a position where a radio wave is detected and a time stamp concerning the time when the radio wave is detected. In particular, the information processing apparatus 10 according to the present embodiment learns about various radio waves existing around the user on a daily basis to create a database concerning various types of radio wave information (hereinafter simply referred to as "daily radio wave information") existing around the user on a daily basis. This allows the information processing apparatus 10 according to the present embodiment to specify a range of daily activities of the user on the basis of radio wave information. By utilizing this database, the information processing apparatus 10 according to the present embodiment specifies radio wave information (for example, radio wave information or the like from a terminal held by a suspicious person) for a user, such as a stalker (hereinafter simply referred to as a "suspicious person") that brings an undesirable situation to the user.

That is, a suspicious person often conducts an activity of "tracking a user and existing around the user." Therefore, the information processing apparatus 10 according to the present embodiment treats radio wave information not registered in the database concerning daily radio wave information among various types of radio wave information detected around the user as radio wave information (hereinafter simply referred to as a "suspicious-person radio wave information candidate" as well) from a terminal held by a suspicious person candidate. Then, in a case where radio wave information registered as a suspicious-person radio wave information candidate is detected as satisfying a predetermined condition, the information processing apparatus 10 according to the present embodiment upgrades the suspicious-person radio wave information candidate to suspicious-person radio wave information for management. This allows the information processing apparatus 10 according to the present embodiment to specify a suspicious person for a user on the basis of radio wave information without utilizing personal information regarding the suspicious person.

<Regarding Radio-wave-information Analyzing Processing>

Hereinafter, focusing attention to a data structure of each type of database stored in the storage unit 105 as well as detailed functions of the analysis unit 107 and the integrated control unit 109 according to the present embodiment, radio-wave-information analyzing processing in the information processing apparatus 10 according to the present embodiment will be described in detail.

[Regarding Data Structure of Each Type of Database]

First, an example of a data structure of each type of database stored in the storage unit 105 according to the present embodiment will be described specifically with reference to FIG. 3 to FIG. 5.

An example of a data structure of a daily radio wave information database (DB) stored in the storage unit 105 according to the present embodiment is schematically shown in FIG. 3. This daily radio wave information DB is a database created concerning radio wave information acquired by a user leading a daily life, such as commuting to office or school. As schematically shown in FIG. 3, detected radio wave information data (or information indicating a storage location of the radio wave information data) has been recorded in this daily radio wave information DB in mutual correlation with a time stamp indicating a date and time when the radio wave information data is detected and positional information concerning a position where the radio wave information data is detected, respectively.

Here, positional information concerning a position where radio wave information data is detected can be easily specified by the information processing apparatus 10 cooperating with a navigation satellite system such as a GPS, various wireless communication base stations, and the like. Note that the method of describing positional information is not limited to the example shown in FIG. 3, but any describing method can be utilized as long as a position where radio wave information data is detected can be specified uniquely by the describing method. In addition, the method of describing a time stamp is also not particularly limited, but a time stamp may be expressed utilizing any describing method as necessary.

In addition, besides these pieces of information, various types of information that can characterize radio wave information itself (for example, information concerning the name of a position, tagged to positional information, or the like) may be correlated in the daily radio wave information DB.

An example of a data structure of a suspicious-person radio wave information candidate DB stored in the storage unit 105 according to the present embodiment is schematically shown in FIG. 4. This suspicious-person radio wave information candidate DB is a database created concerning radio wave information emitted from an electronic appliance or a communication appliance held by a person suspected of being a suspicious person candidate. As schematically shown in FIG. 4, detected radio wave information data (or information indicating a storage location of the radio wave information data) has been recorded in this suspicious-person radio wave information candidate DB in mutual correlation with a time stamp indicating a date and time when the radio wave information data is detected first, a time stamp indicating a date and time when the radio wave information is detected, and the positional information concerning a position where the radio wave information data is detected, respectively. Further, in addition to the above-described information, the number of times that corresponding radio wave information is detected and an evaluation value concerning radio wave information (an evaluation value representing the degree of likelihood of being a suspicious person) are correlated in the suspicious-person radio wave information candidate DB.

An example of a data structure of a suspicious-person radio wave information DB stored in the storage unit 105 according to the present embodiment is schematically shown in FIG. 5. This suspicious-person radio wave information DB is a database created concerning radio wave information emitted from an electronic appliance or a communication appliance held by a person suspected of being a suspicious person. As schematically shown in FIG. 5, detected radio wave information data (or information indicating a storage location of the radio wave information data) has been recorded in this suspicious-person radio wave information DB in mutual correlation with a time stamp indicating a date and time when the radio wave information data is detected first, a time stamp indicating a date and time when the radio wave information is detected, and the positional information concerning a position where the radio wave information data is detected, respectively. Further, in addition to the above-described information, the number of times that corresponding radio wave information is detected and an evaluation value concerning radio wave information (an evaluation value representing the degree of likelihood of being a suspicious person) are correlated in the suspicious-person radio wave information DB. Further, in addition to the above-described information, the number of times that corresponding radio wave information is detected and the risk of a suspicious person (that is, ranking of the suspicious person) corresponding to the radio wave information are correlated in the suspicious-person radio wave information DB.

The analysis unit 107 and the integrated control unit 109 of the information processing apparatus 10 according to the present embodiment are capable of acquiring information concerning a suspicious person candidate and a suspicious person by referring to databases having data structures as shown in FIG. 3 to FIG. 5 at any time.

[Regarding Specific Functions of the Analysis Unit 107 and the Integrated Control Unit 109]

Subsequently, specific functions of the analysis unit 107 and the integrated control unit 109 that the information processing apparatus 10 according to the present embodiment has will be described in detail with reference to FIG. 6 to FIG. 9B.

When new radio wave information is acquired, the analysis unit 107 of the information processing apparatus 10 according to the present embodiment determines at any time whether or not to register the obtained radio wave information in the daily radio wave information DB (that is, whether or not to learn as daily radio wave information). Accordingly, the analysis unit 107 updates the daily radio wave information DB at any time to create a new DB.

Specifically, the analysis unit 107 analyzes whether or not newly acquired radio wave information is radio wave information registered in the most recent daily radio wave information DB at the point of time as shown in FIG. 3. Such an analysis can be achieved by comparing radio wave information recorded in the daily radio wave information DB and the newly acquired radio wave information.

In a case where the newly acquired radio wave information has been registered in the daily radio wave information DB, the analysis unit 107 does not update the daily radio wave information DB. On the other hand, in a case where the newly acquired radio wave information has not been registered in the daily radio wave information DB, the analysis unit 107 analyzes whether or not the newly acquired radio wave information is radio wave information recorded in the most recent suspicious-person radio wave information DB at the point of time as shown in FIG. 5.

In a case where the newly acquired radio wave information has been registered in the suspicious-person radio wave information DB, the analysis unit 107 outputs the fact that a radio wave registered in the suspicious-person radio wave information DB has been detected to the integrated control unit 109. On the other hand, in a case where the newly acquired radio wave information has not been registered in the suspicious-person radio wave information DB, the analysis unit 107 determines whether the newly acquired radio wave information satisfies a predetermined condition or not.

That is, the analysis unit 107 determines whether the newly acquired radio wave information is a radio wave whose detection history exists in a past predetermined period. In a case where the newly acquired radio wave information is a radio wave whose detection history exists in a past predetermined period and is a radio wave detected at the same place every time according to associated positional information, the analysis unit 107 registers the newly acquired radio wave information in the daily radio wave information DB.

By carrying out such processing at any time, it is possible for the analysis unit 107 of the information processing apparatus 10 according to the present embodiment to update the daily radio wave information DB as shown in FIG. 3.

Through processing as described above, the analysis unit 107 and the integrated control unit 109 carry out radio-wave-information analyzing processing as shown in FIG. 6 at any time with the daily radio wave information DB being updated. The radio-wave-information analyzing processing carried out in the analysis unit 107 and the integrated control unit 109 according to the present embodiment will be described below in detail with reference to FIG. 6.

The analysis unit 107 and the integrated control unit 109 according to the present embodiment treat newly acquired radio wave information as three classified stages of (1) daily radio wave information, (2) a candidate for suspicious-person radio wave information, and (3) suspicious-person radio wave information. That is, the analysis unit 107 and the integrated control unit 109 according to the present embodiment treat radio wave information that satisfies a condition of "not being included in daily radio wave information" as a candidate for suspicious-person radio wave information, and treat "radio wave information that satisfies a predetermined condition among pieces of radio wave information included in candidates for suspicious-person radio wave information" as suspicious-person radio wave information.

When radio wave information is newly acquired, the analysis unit 107 according to the present embodiment determines whether the newly acquired radio wave is a radio wave detected on a daily basis or not referring to the daily radio wave information DB (determination 1). In a case where the newly acquired radio wave is a radio wave detected on a daily basis, the analysis unit 107 and the integrated control unit 109 wait for acquisition of new radio wave information.

On the other hand, in a case where the newly acquired radio wave is not a radio wave detected on a daily basis, the analysis unit 107 determines whether the newly acquired radio wave has been registered in the suspicious-person radio wave information DB or not referring to the suspicious-person radio wave information DB (determination 2). In a case where a radio wave of interest has been registered in the suspicious-person radio wave information DB, it is possible to determine that a suspicious person exists in the vicinity of a user (a holder of the information processing apparatus 10) (processing 1). Therefore, the analysis unit 107 outputs the fact that the newly acquired radio wave has been registered in the suspicious-person radio wave information DB to the integrated control unit 109. The integrated control unit 109 receives such information to warn the user that a suspicious person exists nearby.

On this occasion, the analysis unit 107 updates registration contents of the suspicious-person radio wave information DB (for example, time stamps, positional information, and the number of times of detection) when carrying out the above-described processing 1. In addition, in a case where the number of times of detection, a detection time, and the like of newly detected suspicious-person radio wave information satisfy predetermined conditions, or in a case where the risk level of the suspicious person has been designated by the user, or the like, the analysis unit 107 updates the risk level in the suspicious-person radio wave information DB.

Here, the method of updating the risk level of a suspicious person is not particularly limited, but any method may be employed. For example, the analysis unit 107 may increment the risk level one by one whenever the number of times of detection increases, or may increment the risk level by one whenever a threshold value is exceeded by a predetermined number of times. In addition, a weighting coefficient may be changed in accordance with when and where a radio wave is detected to adjust such that the number of times of detection at a time is equivalent to a plurality of times of detection.

Figure 7:
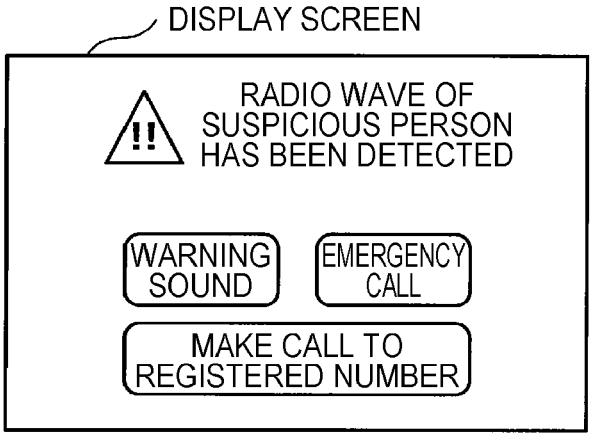
FIG. 7 is an explanatory diagram schematically showing an example of a display screen of the information processing apparatus according to the embodiment.

In addition, details of the processing of warning a user by the integrated control unit 109 are not particularly limited. For example, as the processing of warning a user, the integrated control unit 109 may perform processing such as activating a vibrator mounted on the information processing apparatus 10, producing a predetermined warning sound, or automatically oscillating a call to a specific contact (for example, a public institution such as a police, parents, best friends, or the like) registered in advance. On this occasion, the integrated control unit 109 causes a display screen as shown in FIG. 7 to be displayed on a display or the like of the information processing apparatus 10 in cooperation with the display control unit 111.

Furthermore, the integrated control unit 109 may adjust the time for warning a user and the warning method in accordance with the risk level of a suspicious person recorded in the suspicious-person radio wave information DB. That is, the integrated control unit 109 may issue a warning by a vibrator at a place somewhat distant from a position where a radio wave is detected for a suspicious person of a low risk level, and on the other hand, for a suspicious person of a high risk level, may adjust the time for warning a user and the warning method, such as by issuing a warning sound whose volume has been set high, at a point of time when a radio wave is detected.

On the other hand, in a case where the newly acquired radio wave has not been registered in the suspicious-person radio wave information DB, the analysis unit 107 determines whether the newly acquired radio wave has been registered in the suspicious-person radio wave information candidate DB or not referring to the suspicious-person radio wave information candidate DB (determination 3). In a case where a radio wave of interest has not been registered in the suspicious-person radio wave information candidate DB, the newly acquired radio wave is registered in the suspicious-person radio wave information candidate DB as a candidate for suspicious-person radio wave information except for a radio wave detected at the same place every time (processing 2).

On the other hand, in a case where the newly acquired radio wave has been registered in the suspicious-person radio wave information DB, the analysis unit 107 updates registration contents registered in the suspicious-person radio wave information candidate DB (processing 3). Specifically, the analysis unit 107 updates registration contents of the suspicious-person radio wave information candidate DB (for example, time stamps, positional information, and the number of times of detection). In addition, the analysis unit 107 updates an evaluation value of a candidate for suspicious-person radio wave information in accordance with the number of times of detection.

The method of updating an evaluation value of a candidate for suspicious-person radio wave information is not particularly limited, but any method may be employed. For example, the analysis unit 107 may increment an evaluation value one by one whenever the number of times of detection increases, or may increment an evaluation value by one whenever the threshold value is exceeded by a predetermined number of times. In addition, a weighting coefficient may be changed in accordance with when and where a radio wave is detected to adjust such that the number of times of detection at a time is equivalent to a plurality of times of detection.

When updating of registration contents is terminated, the analysis unit 107 determines whether radio wave information after updating satisfies a predetermined condition or not (determination 4).

The analysis unit 107 has parameters such as a suspicious-person specifying period, a threshold value of an evaluation value, and a threshold value of the number of times of detection, for example, as parameters for performing such determinations. Here, the suspicious-person specifying period is a parameter that represents a period regarding how far to go back to evaluate radio waves of a suspicious person. In addition, the threshold value of an evaluation value is a parameter for designating that a candidate for suspicious-person radio wave information is to be treated as suspicious-person radio wave information in a case where an evaluation value becomes higher than or equal to this threshold value, and the threshold value of the number of times of detection is a parameter for designating that a candidate for suspicious-person radio wave information is to be treated as suspicious-person radio wave information in a case where the number of times of detection becomes higher than or equal to this threshold value.

By combining such parameters as necessary, it is possible to set a determination condition, such as "assuming a radio wave detected by the threshold value of the number of times of detection (for example, five times) or higher during the suspicious-person specifying period (for example, three days) to be suspicious-person radio wave information", for example. In addition to such a determination condition, it is also possible to set a determination condition such as "a radio wave having become higher than or equal to the threshold value of an evaluation value during the suspicious-person specifying period" or "radio waves detected in a specific time slot such as a time slot for commuting to office or school during the suspicious-person specifying period" or the like.

In a case where a candidate for suspicious-person radio wave information that satisfies a predetermined condition does not exist, the analysis unit 107 and the integrated control unit 109 wait for acquisition of new radio wave information. On the other hand, a candidate for suspicious person information that satisfies a predetermined condition exists, the analysis unit 107 deletes the radio wave information from the suspicious-person radio wave information candidate DB, and then registers the radio wave information in the suspicious-person radio wave information DB (processing 4).

By carrying out such processing at any time, it is possible for the analysis unit 107 and the integrated control unit 109 to register and update suspicious radio wave information. Note that, in a case where processing as described above is carried out, radio waves from appliances held by mere passersby are once registered in the suspicious-person radio wave information candidate DB as candidates for suspicious-person radio wave information. However, if an evaluation value is lower than a threshold value when the suspicious-person specifying period elapses, the radio wave information only needs to be deleted from the suspicious-person radio wave information candidate DB. This can eliminate the possibility that mere passersby are registered as suspicious persons.

In addition, by further utilizing a publicly-known machine learning technology or the like to perform further learning processing on the basis of the created daily radio wave information DB, the analysis unit 107 is also capable of estimating a range of daily activities of a user. By further utilizing knowledge concerning such a range of activities, the analysis unit 107 is also capable of performing suspicious-person detection processing as will be described below. That is, it is considered that a suspicious person such as a stalker for a user of the information processing apparatus 10 is stalking the user. Therefore, assuming that a stalking radio wave exists even outside the range of daily activities of the user in a case where an existing position of the user is not included in the range of daily activities and radio wave information registered in the suspicious-person radio wave information candidate DB is detected, the analysis unit 107 may treat the candidate for suspicious-person radio wave information as suspicious-person radio wave information, and may increase the evaluation value or the risk level.

If a user utilizes public transportation, such as a bus, a train, or an airplane, for example, in a case where radio-wave-information analyzing processing as described above is carried out, people merely riding together in these types of public transportation could be registered as suspicious persons. Therefore, it is preferable that the analysis unit 107 utilizes outputs from various sensors, such as an acceleration sensor, provided in the information processing apparatus 10, and outputs from a navigation satellite system, such as GPS, to specify a means of transportation that the user is using and a moving speed, and controls on/off of the function of registering suspicious-person radio wave information in accordance with the means of transportation and the moving speed. That is, in a case where it is determined that the user is moving at a speed higher than or equal to a predetermined threshold value, it is preferable that the analysis unit 107 determines that the user is moving in a vehicle, and turns off the function of registering suspicious-person radio wave information.

Note that radio wave information relevant to a suspicious person is automatically specified by performing processing as described above, whilst the analysis unit 107 according to the present embodiment may cooperate with each type of server 20 and the like to further analyze the contents of the suspicious-person radio wave information candidate DB and the suspicious-person radio wave information DB having been created. For example, specified radio wave information may be associated with various types of user information registered on a network by a publicly-known method, and then may be further corrected in accordance with various user evaluations (for example, reliability of an individual determined to be a suspicious person), and the like registered on a network.

In addition, the analysis unit 107 may share various types of DBs created as described above with devices on the network.

Figure 8A:
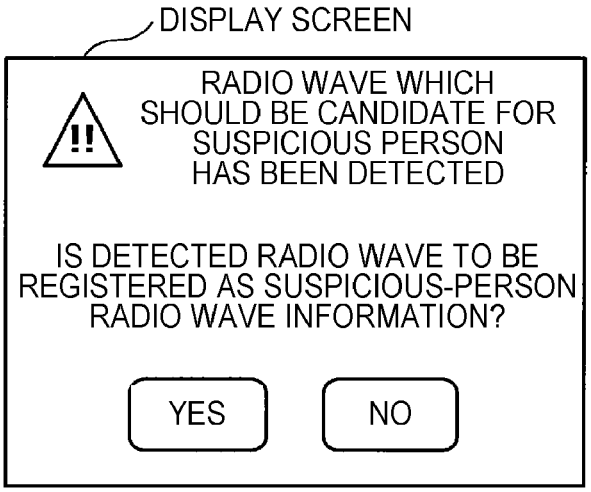
FIG. 8A is an explanatory diagram schematically showing an example of a display screen of the information processing apparatus according to the embodiment.

Here, in a case where a radio wave which should be treated as a candidate for suspicious-person radio wave information is newly detected, a case where it is desired to treat the radio wave information as suspicious-person radio wave information from the outset depending on circumstances is conceivable. Therefore, the integrated control unit 109 may cause a display screen as shown in FIG. 8A to be displayed on a display or the like of the information processing apparatus 10 in cooperation with the display control unit 111 to ask a user whether radio wave information which should be essentially treated as a candidate for suspicious-person radio wave information is to be treated as suspicious-person radio wave information skipping the level of a candidate for suspicious-person radio wave information.

Figure 8B:
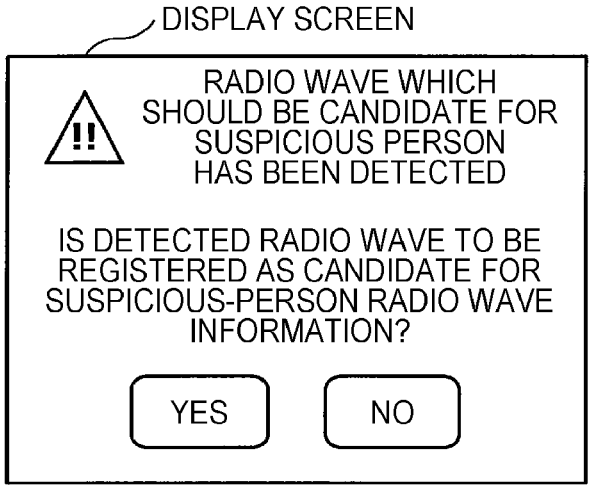
FIG. 8B is an explanatory diagram schematically showing an example of a display screen of the information processing apparatus according to the embodiment.
Figure 8C:
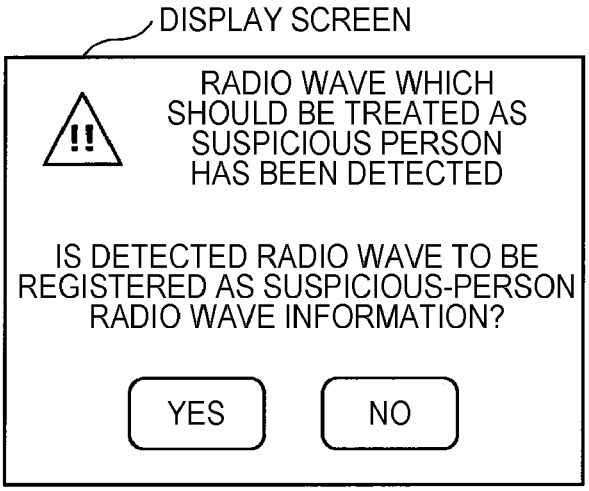
FIG. 8C is an explanatory diagram schematically showing an example of a display screen of the information processing apparatus according to the embodiment.

In addition, in the processing method as described above, a friend or the like who stays with the user on many occasions could also be treated as a suspicious person candidate or a suspicious person. Therefore, the integrated control unit 109 may cause display screens as shown in FIG. 8B and FIG. 8C to be displayed on a display or the like of the information processing apparatus 10 in cooperation with the display control unit 111 to ask the user about the level of treating radio wave information of interest.

A situation where a user of the information processing apparatus 10 according to the present embodiment reviews a detection status of a candidate for suspicious-person radio wave information or suspicious-person radio wave information is also conceivable. Therefore, the integrated control unit 109 may utilize time stamps and positional information registered in the suspicious-person radio wave information candidate DB and the suspicious-person radio wave information DB to cause a detection status of a candidate for suspicious-person radio wave information or suspicious-person radio wave information to be displayed in a time line or on a map.

Figure 9A:
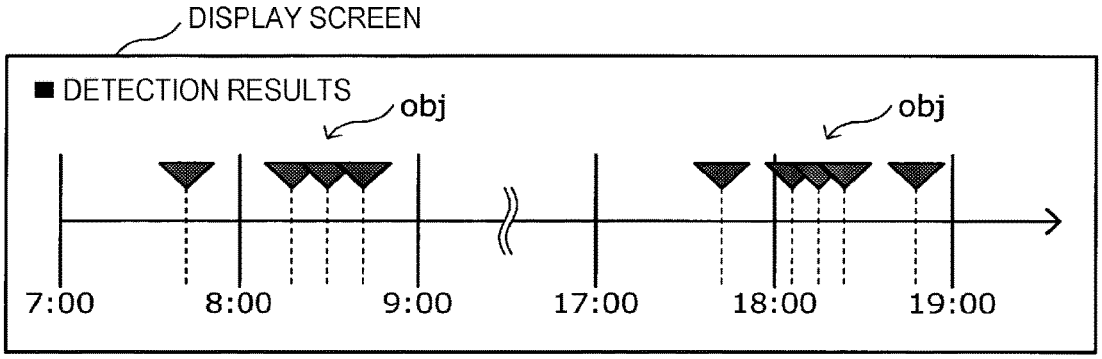
FIG. 9A is an explanatory diagram schematically showing an example of a display screen of the information processing apparatus according to the embodiment.

As schematically shown in FIG. 9A, in a case of displaying a detection status of a candidate for suspicious-person radio wave information or suspicious-person radio wave information in a time line, the integrated control unit 109 may refer to time stamps registered in each DB, and then, at a position corresponding to a detection time of the radio wave information, cause an object obj that suggests the detection time to be displayed in cooperation with the display control unit 111.

Figure 9B:
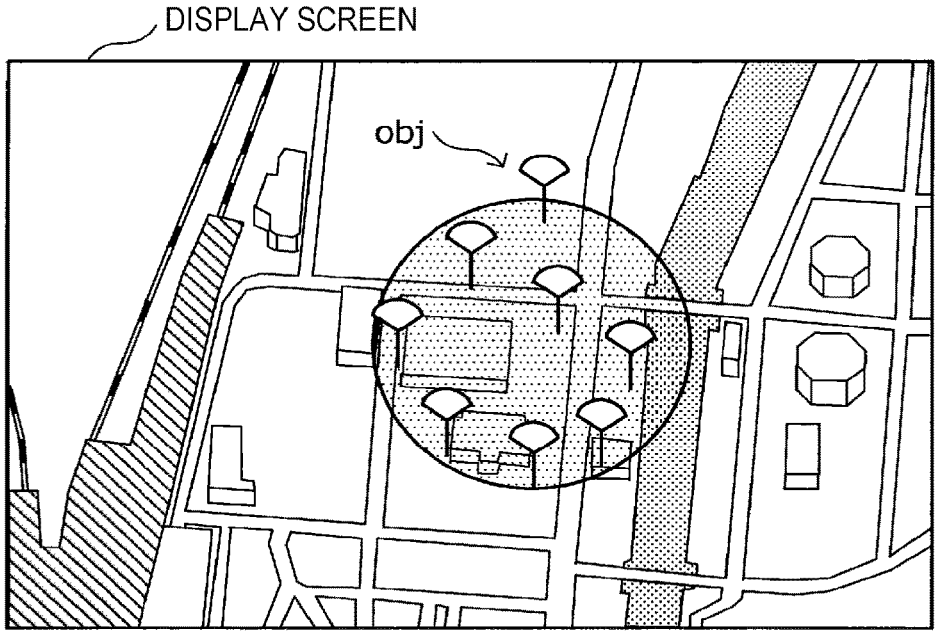
FIG. 9B is an explanatory diagram schematically showing an example of a display screen of the information processing apparatus according to the embodiment.

In addition, as schematically shown in FIG. 9B, in a case of displaying a detection status of a candidate for suspicious-person radio wave information or suspicious-person radio wave information on a map, the integrated control unit 109 may refer to positional information registered in each DB and then, at a detection position of the radio wave information, cause the object obj that suggests the detection position to be displayed, in cooperation with the display control unit 111. In addition, in a case of displaying a detection status on a map, information concerning a detection time may be further added such as by further adding time information to the object obj that suggests a detection position, or changing the object in color or shape, for example, in accordance with the time.

A data structure of each type of database stored in the storage unit 105 and radio-wave-information analyzing processing in the information processing apparatus 10 according to the present embodiment have been described above in detail with reference to FIG. 3 to FIG. 9B.

<Regarding Flow of Information Processing Method>

Figure 10:
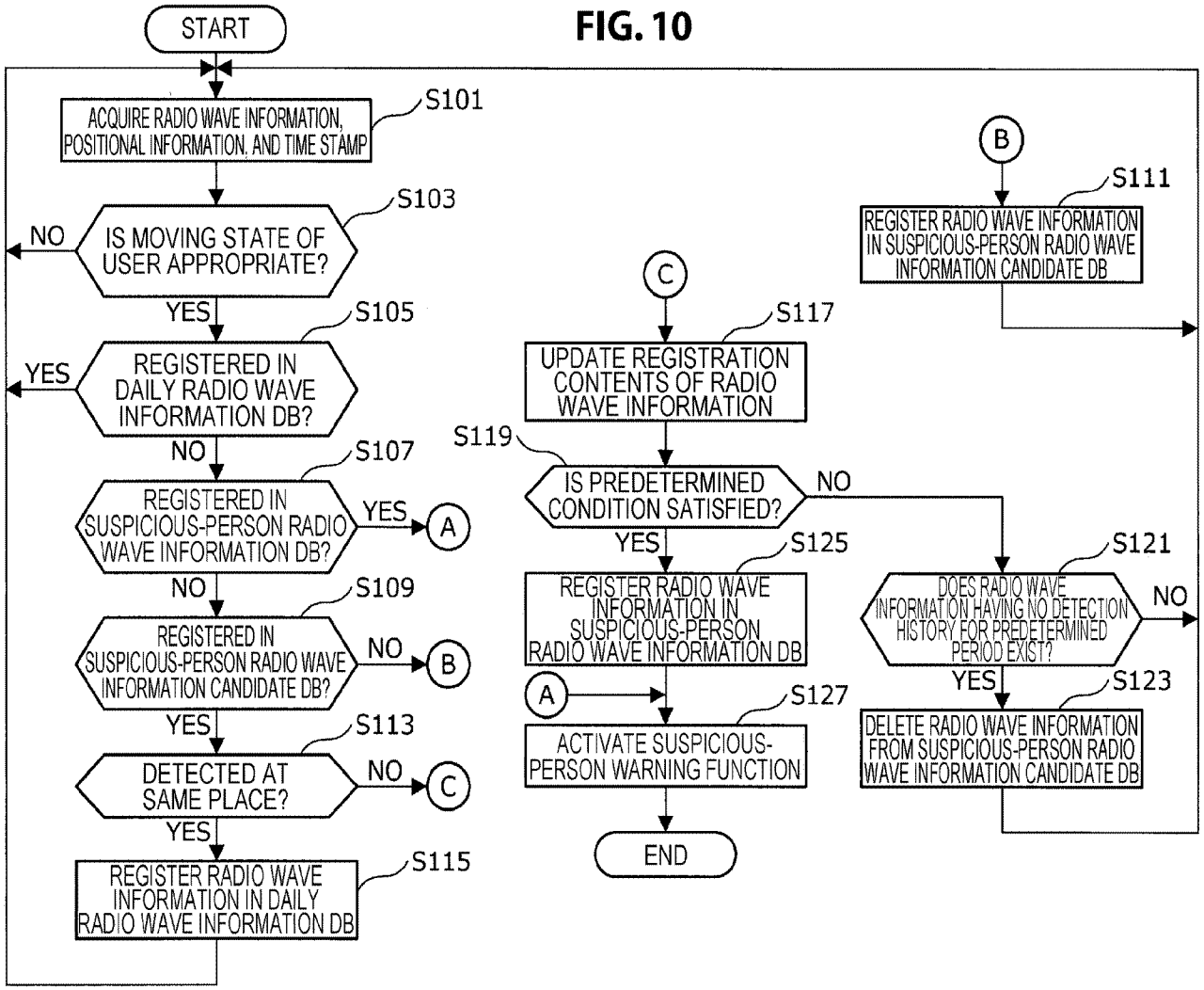
FIG. 10 is a flowchart showing an example of a flow of an information processing method according to the embodiment.

Next, an example of a flow of an information processing method carried out in the information processing apparatus 10 according to the present embodiment will be briefly described with reference to FIG. 10. FIG. 10 is a flowchart showing an example of a flow of an information processing method according to the present embodiment.

In the information processing method according to the present embodiment, when new radio wave information is detected, radio wave information, positional information, and a time stamp are sent from each type of terminal as shown in FIG. 1 or the radio wave detection unit 113. These pieces of information transmitted to the data recording unit 103 of the information processing apparatus 10 are registered in each DB stored in the storage unit 105 or the like (step S101).

Thereafter, the analysis unit 107 of the information processing apparatus 10 determines whether a moving state of a user is appropriate (that is, whether the user is moving in a vehicle) (step S103). In a case where it is determined that the user is moving in a vehicle, the information processing apparatus 10 returns to step S101 to continue processing. On the other hand, in a case where it is determined that the user is not moving in a vehicle, the analysis unit 107 refers to the daily radio wave information DB stored in the storage unit 105 or the like to determine whether radio wave information of interest has already been registered in the daily radio wave information DB (step S105).

In a case where the radio wave information of interest has already been registered in the daily radio wave information DB, the information processing apparatus 10 returns to step S101 to continue processing. On the other hand, in a case where the radio wave information of interest has not been registered in the daily radio wave information DB, the analysis unit 107 refers to the suspicious-person radio wave information DB stored in the storage unit 105 or the like to determine whether the radio wave information of interest has already been registered in the suspicious-person radio wave information DB (step S107).

In a case where the radio wave information of interest has already been registered in the suspicious-person radio wave information DB, the analysis unit 107 notifies the integrated control unit 109 that the radio wave information of interest has been registered in the suspicious-person radio wave information DB. The integrated control unit 109 having received the notification transitions to step S127 to activate a suspicious-person warning function. On the other hand, in a case where the radio wave information of interest has not been registered in the suspicious-person radio wave information DB, the analysis unit 107 refers to the suspicious-person radio wave information candidate DB stored in the storage unit 105 or the like to determine whether the radio wave information of interest has already been registered in the suspicious-person radio wave information candidate DB (step S109).

In a case where the radio wave information of interest has not been registered in the suspicious-person radio wave information candidate DB, the analysis unit 107 registers the radio wave information of interest in the suspicious-person radio wave information candidate DB (step S111). Thereafter, the information processing apparatus 10 returns to step S101 to continue processing. On the other hand, in a case where the radio wave information of interest has been registered in the suspicious-person radio wave information candidate DB, the analysis unit 107 refers to positional information in the suspicious-person radio wave information candidate DB to determine whether the radio wave information of interest has been detected at the same place as before (step S113).

In a case where the radio wave information of interest has been detected at the same place as before, the analysis unit 107 deletes the radio wave information of interest from the suspicious-person radio wave information candidate DB, and registers the radio wave information in the daily radio wave information DB (step S115). Thereafter, the information processing apparatus 10 returns to step S101 to continue processing. On the other hand, in a case where the radio wave information of interest has not been detected at the same place as before, the analysis unit 107 updates registration contents of the radio wave information of interest (step S117).

Thereafter, the analysis unit 107 determines whether the radio wave information of interest satisfies a predetermined condition or not (step S119). In a case where the radio wave information of interest does not satisfy a predetermined condition, the analysis unit 107 refers to the suspicious-person radio wave information candidate DB as a whole to determine whether radio wave information having no detection history for a predetermined period exists or not (step S121). In a case where the radio wave information does not exist, the information processing apparatus 10 returns to step S101 to continue processing. On the other hand, in a case where the radio wave information exists, the analysis unit 107 deletes the radio wave information from the suspicious-person radio wave information candidate DB (step S123). Thereafter, the information processing apparatus 10 returns to step S101 to continue processing.

In addition, in step S119, in a case where radio wave information that satisfies the predetermined condition exists, the radio wave information is deleted from the suspicious-person radio wave information candidate DB, and the radio wave information is registered in the suspicious-person radio wave information DB (step S125). Thereafter, the analysis unit 107 notifies the integrated control unit 109 that the radio wave information of interest has been registered in the suspicious-person radio wave information DB. The integrated control unit 109 having received the notification transitions to step S127 to activate the suspicious-person warning function.

When it is notified that radio wave information registered in the suspicious-person radio wave information DB has been detected, the integrated control unit 109 activates the suspicious-person warning function (step S127) In addition, the analysis unit 107 updates relevant registration contents of the suspicious-person radio wave information DB according to necessity.

When processing is performed in a flow as described above, in the information processing method according to the present embodiment, it is possible to specify a suspicious person for a user on the basis of radio wave information without utilizing personal information regarding the suspicious person.

The information processing apparatus and the information processing method according to the first embodiment of the present disclosure have been described above in detail.

(Second Embodiment)

An information processing apparatus according to a second embodiment of the present disclosure will be described below in detail with reference to FIG. 11 to FIG. 18.

Figure 11:
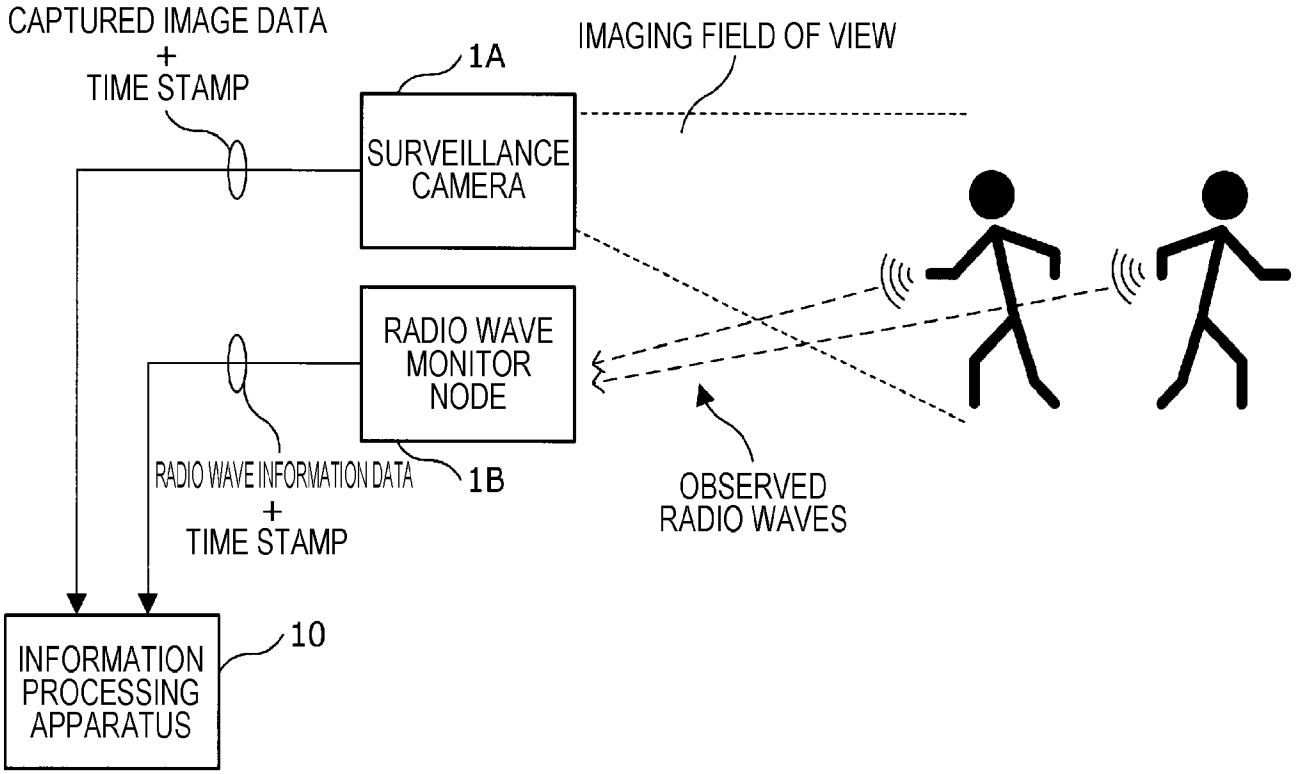
FIG. 11 is an explanatory diagram for describing an information processing apparatus according to a second embodiment the present disclosure.
Figure 15:
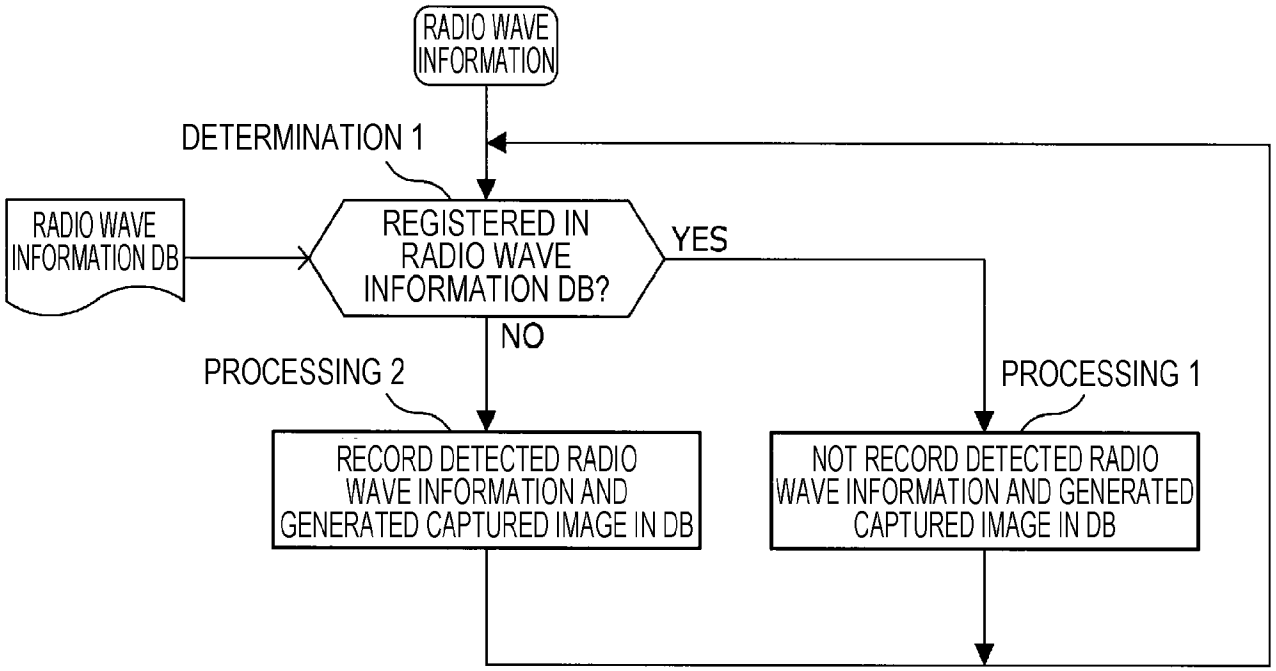
FIG. 15 is a flowchart for describing radio-wave-information analyzing processing carried out in the information processing apparatus according to the embodiment.
Figure 16:
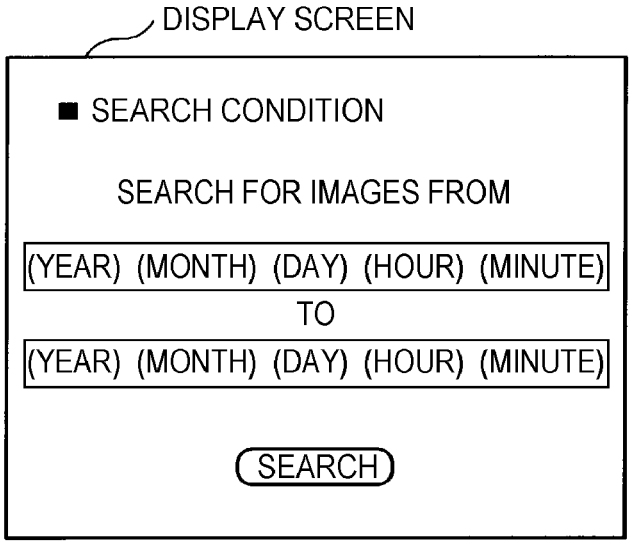
FIG. 16 is an explanatory diagram schematically showing an example of a display screen of the information processing apparatus according to the embodiment.
Figure 17:
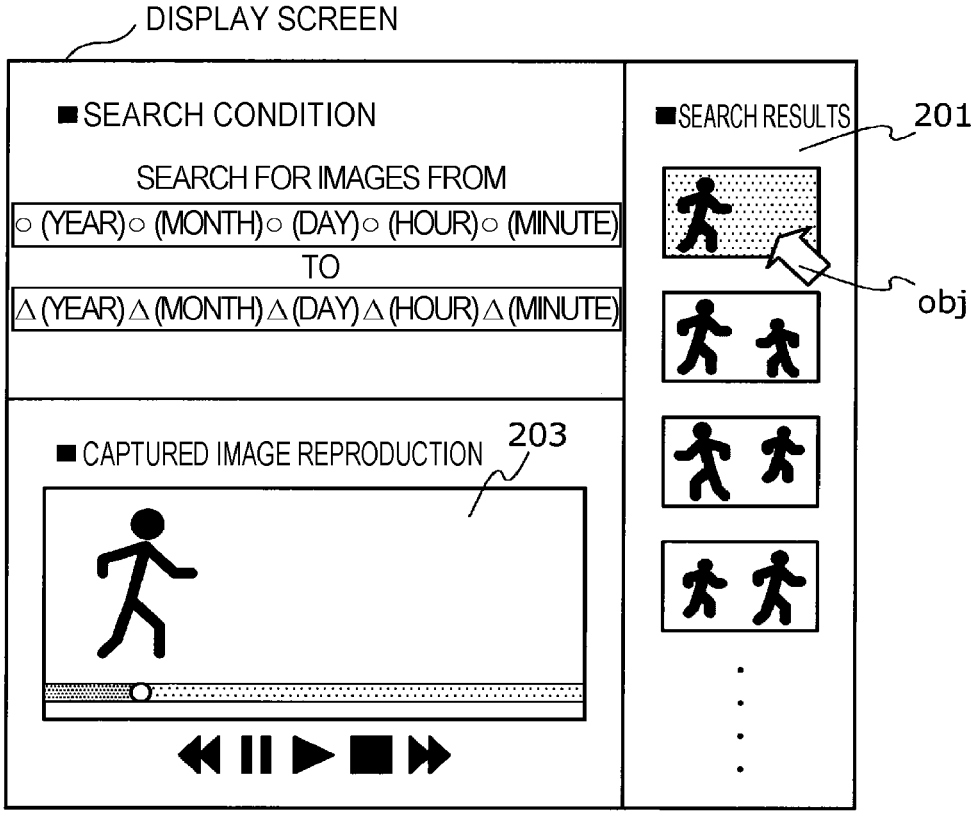
FIG. 17 is an explanatory diagram schematically showing an example of a display screen of the information processing apparatus according to the embodiment.
Figure 18:
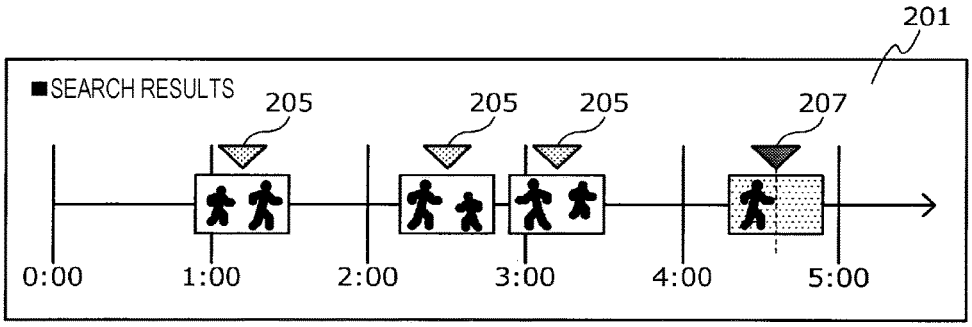
FIG. 18 is an explanatory diagram schematically showing an example of a display screen of the information processing apparatus according to the embodiment.

FIG. 11 is an explanatory diagram for describing the information processing apparatus according to the second embodiment of the present disclosure. FIG. 12 is an explanatory diagram showing an example of a data structure of an association database for use in the information processing apparatus according to the present embodiment, FIG. 13 is an explanatory diagram showing an example of a data structure of a radio wave information database for use in the information processing apparatus according to the present embodiment, and FIG. 14 is an explanatory diagram showing an example of a data structure of a captured image database for use in the information processing apparatus according to the present embodiment. FIG. 15 is a flowchart for describing radio-wave-information analyzing processing carried out in the information processing apparatus according to the present embodiment. FIG. 16 to FIG. 18 are explanatory diagrams each schematically showing an example of a display screen of the information processing apparatus according to the present embodiment.

<Regarding Surveillance-camera-captured-image Extracting Processing by Means of Radio Wave Information>

The information processing apparatus 10 according to the present embodiment is an apparatus that has a configuration as shown in FIG. 2A and functions in cooperation with the imaging system 1 having the surveillance camera 1A and the radio wave monitor node 1B as shown in FIG. 1.

Specifically, the information processing apparatus 10 according to the present embodiment acquires captured image data and radio wave information data generated in the imaging system 1 installed at one or more sites (in more detail, captured image data generated by the surveillance camera 1A and radio wave information data generated by the radio wave monitor node 1B). Then, the information processing apparatus 10 according to the present embodiment determines whether the acquired radio wave information data satisfies a predetermined condition or not, and accumulates at any time radio wave information data that satisfies the predetermined condition and captured image data corresponding to the radio wave information data in the storage unit 105.

Here, as schematically shown in FIG. 11, the surveillance camera 1A provided at any location is an example of an imaging device that images various subjects to be imaged that are positioned in an imaging field of view, and is an appliance that can generate a still image or a moving image concerning a subject to be imaged. The surveillance camera 1A is not particularly limited, but various imaging devices can be utilized as necessary. In addition, the radio wave monitor node 1B provided at any location is a device that observes various radio waves existing around the radio wave monitor node 1B, and generates radio wave information concerning the observed radio waves. This radio wave monitor node 1B is also not particularly limited, but various imaging devices such as a wireless LAN monitor node, can be utilized as necessary.

Here, it is assumed that the surveillance camera 1A and the radio wave monitor node 1B provided at a certain location have been associated with each other in advance, and information indicating that the surveillance camera 1A existing at which location corresponds to which radio wave monitor node 1B has been stored in the information processing apparatus 10 in advance. In addition, it is assumed that the surveillance camera 1A and the radio wave monitor node 1B provided at a certain location have been set in advance so as to be temporally synchronized with each other.

Upon imaging a subject to be imaged that is positioned in the imaging field of view to generate a captured image including a still image or video, the surveillance camera 1A outputs at any time image data of the captured image (imaged image data) and a time stamp that represents a time when the captured image data is generated to the information processing apparatus 10. In addition, upon detecting radio waves existing around the radio wave monitor node 1B, the radio wave monitor node 1B observes various feature values (such as identification information specific to radio waves and electric field intensity, for example) that characterize the radio waves, and assuming them as radio wave information, outputs at any time data regarding the radio wave information (radio wave information data) and a time stamp that represents a time when the radio wave information is generated to the information processing apparatus 10.

Note that it is preferable that captured image data generated by the surveillance camera 1A is correlated with identification information (ID information) specific to the surveillance camera 1A having generated the captured image data, and it is preferable that radio wave information data generated by the radio wave monitor node 1B is correlated with identification information (ID information) specific to the radio wave monitor node 1B having generated the radio wave information data. This allows the information processing apparatus 10 having acquired these pieces of data to easily grasp at which location the surveillance camera 1A and the radio wave monitor node 1B having sent the acquired data are provided.

With the recent developments in information communication technology, a person has often held an electronic appliance or a communication appliance having a wireless communication function, such as a mobile phone, a smartphone, a portable game console, a tablet terminal, or a wearable terminal. In addition, there are also many objects (for example, various types of transportation means, such as a vehicle, on which a person holding an appliance as described above is aboard or on which an appliance as described above has been mounted) including/containing an appliance such as a mobile phone, a smartphone, a portable game console, a tablet terminal, a wearable terminal, or a car navigation system. Thus, it can be said that radio waves observed by the radio wave monitor node 1B are highly likely to also include radio waves from a subject to be imaged that holds or includes an electronic appliance or a communication appliance having a wireless communication function as described above and having been imaged by the surveillance camera 1A.

The information processing apparatus 10 according to the present embodiment records captured image data sent from the surveillance camera 1A at each location in correlation with the time stamp sent together, and records radio wave information data sent from the radio wave monitor node 1B at each location in correlation with the time stamp sent together. Here, since the surveillance camera 1A and the radio wave monitor node 1B have been associated with each other in advance and have been set so as to temporally synchronize with each other as described earlier, the information processing apparatus 10 is capable of associating captured image data imaged by the surveillance camera 1A and radio wave information generated by the radio wave monitor node 1B with each other by way of a time stamp.

The information processing apparatus 10 according to the present embodiment focuses attention to radio wave information data and captured image data having a relationship as described above, and searches a radio wave information database concerning radio wave information having already been detected. Thereafter, in a case where radio wave information data not registered in the radio wave information database is obtained, the radio wave information data and captured image data are accumulated in the storage unit 105 or the like. Then, in a case where an operation of searching for captured image data newly registered during a predetermined period is input by a user of the information processing apparatus 10, the captured image data is found and extracted utilizing the radio wave information database.

<Regarding Radio-wave-information Analyzing Processing>

Hereinafter, focusing attention to a data structure of each type of database stored in the storage unit 105 as well as detailed functions of the analysis unit 107 and the integrated control unit 109 according to the present embodiment, radio-wave-information analyzing processing in the information processing apparatus 10 according to the present embodiment will be described in detail.

[Regarding Data Structure of Each Type of Database]

First, an example of a data structure of each type of database stored in the storage unit 105 according to the present embodiment will be described specifically with reference to FIG. 12 to FIG. 14.

FIG. 12 shows an example of a data structure of a database showing a correspondence between one or more surveillance cameras 1A from which the information processing apparatus 10 acquires captured image data and the radio wave monitor node 1B associated with each of the surveillance cameras 1A. As schematically shown in FIG. 12, in a database (hereinafter simply referred to as an "association DB" as well) showing the correspondence, ID information specific to the surveillance camera 1A and ID information specific to the radio wave monitor node 1B associated with this surveillance camera 1A have been recorded in relation to each other. By referring to this association DB, the respective processing units (in particular, the analysis unit 107 and the integrated control unit 109) of the information processing apparatus 10 can easily grasp which surveillance camera 1A and which radio wave monitor node 1B have been associated.

Note that the type of ID information recorded in the association DB as described above and the ID information describing method are not particularly limited, but any type and any describing method that are publicly known can be utilized as necessary.

FIG. 13 shows an example of a data structure of a database (hereinafter simply referred to as a "radio wave information DB" as well) concerning radio wave information data generated by radio wave each of the radio wave monitor nodes 1B, and FIG. 14 shows an example of a data structure of a database (hereinafter simply referred to as a "captured image DB" as well) concerning captured image data generated by each of the surveillance cameras 1A.

As schematically shown in FIG. 13, in the radio wave information DB, radio wave information data generated by a radio wave monitor node 1B (or information indicating a storage location of the radio wave information data) has been recorded in correlation with a time stamp indicating the date and time when the radio wave information data is generated. It is preferable that, in the radio wave information DB, ID information regarding a radio wave monitor node 1B having generated the radio wave information data has been further correlated. In addition, as schematically shown in FIG. 14, in the captured image DB, captured image data imaged by a certain surveillance camera 1A (or information indicating a storage location of the captured image data) has been recorded in correlation with a time stamp indicating the date and time when the captured image data is generated. It is also preferable that, in the captured image DB, ID information regarding a surveillance camera 1A having generated the captured image data has been further correlated.

Note that information recorded in the radio wave information DB shown in FIG. 13 and information recorded in the captured image DB shown in FIG. 14 are not limited to those shown in FIG. 13 and FIG. 14, but any information concerning radio wave information data and captured image data can be added to these DBs. In addition, the method of describing time stamps shown in FIG. 13 and FIG. 14 is not particularly limited, but time stamps may be expressed utilizing any describing method as necessary.

Note that radio wave information data stored in the storage unit 105 may have any data structure as long as feature values that characterize observed radio waves, such as ID information specific to observed radio waves and the electric field intensity, have been described. Identification information such as a MAC address, ESSID, or UUID which is information specific to each observed radio wave, the electric field intensity of radio waves, and the like have been described in radio wave information generated by the radio wave monitor node 1B and stored in the storage unit 105. In addition, any feature value that characterizes observed radio waves may be described besides these feature values. In addition, in a case where a plurality of radio waves are observed at a time in a certain radio wave monitor node 1B, information as described above is recorded in the radio wave information with respect to each of the observed radio waves.

By referring to the databases having data structures as shown in FIG. 12 to FIG. 14 at any time, it is possible for the analysis unit 107 and the integrated control unit 109 of the information processing apparatus 10 according to the present embodiment to acquire various types of information concerning radio wave information data and captured image data.

[Regarding Specific Functions of the Analysis Unit 107 and the Integrated Control Unit 109]

Subsequently, specific functions of the analysis unit 107 and the integrated control unit 109 that the information processing apparatus 10 according to the present embodiment has will be described in detail with reference to FIG. 15 to FIG. 18.

As schematically shown in FIG. 15, when new radio wave information is acquired, the analysis unit 107 of the information processing apparatus 10 according to the present embodiment carries out processing as will be described below in cooperation with the data recording unit 103. That is, when the information processing apparatus 10 according to the present embodiment acquires new radio wave information, the analysis unit 107 refers to the radio wave information DB stored in the storage unit 105 or the like to determine whether radio wave information of interest has already been registered in the radio wave information DB (determination 1). In a case where the radio wave information of interest has already been registered in the radio wave information DB, the analysis unit 107 waits for acquisition of new radio wave information without causing captured image data associated with the radio wave information of interest to be recorded (processing 1). On the other hand, in a case where the radio wave information of interest has not been registered in the radio wave information DB, the analysis unit 107 records the radio wave information data and captured image data in cooperation with the data recording unit 103. That is, the analysis unit 107 causes the data recording unit 103 to record the radio wave information of interest and captured image data associated with the radio wave information in databases respectively (processing 2), and then waits for acquisition of new radio wave information. On this occasion, the data recording unit 103 shall record each piece of data in association with a time stamp when recording in the databases.

By performing processing as described above based on radio wave information in cooperation with the data recording unit 103, it is possible for the analysis unit 107 according to the present embodiment to accumulate captured images corresponding to newly detected radio wave information.

Note that whether the radio wave information of interest has been registered in the radio wave information DB or not can be determined by utilizing a radio wave pattern (obtained by schematically showing the degree of electric field intensity of each radio wave included in the radio wave information) shown by the radio wave information of interest and performing pattern matching between a radio wave pattern shown by recorded radio wave information and a radio wave pattern shown by the radio wave information of interest. Here, the degree of similarity utilized in the pattern matching is not particularly limited, but it is possible to utilize a publicly-known degree of similarity, such as a cross-correlation coefficient, for example.

When providing a user with captured image data accumulated as described above, processing as will be described below is carried out in the integrated control unit 109.

When processing of searching for and viewing accumulated captured image data is started in accordance with a user operation, the integrated control unit 109 causes a display screen as shown in FIG. 16 to be displayed on a display or the like of the information processing apparatus 10 in cooperation with the display control unit 111. On this display screen, a search period designating field for designating a search period for captured image data is provided as shown in FIG. 16.

When data is input in the search period designating field shown in FIG. 16 by a user operation, and thereafter a search button is selected, the integrated control unit 109 refers to time stamp columns in the radio wave information DB recorded in the storage unit 105 or the like on the basis of a designated search period. The integrated control unit 109 searches the time stamp columns, and if radio wave information whose time stamp is included in the range of the designated search period exists, extracts the radio wave information data.

In the radio wave information DB, each piece of radio wave information has been correlated with the ID information regarding the radio wave monitor node 1B having detected the radio wave information as schematically shown in FIG. 13. For each piece of radio wave information data extracted by the above-described processing, the integrated control unit 109 specifies the ID information regarding the corresponding radio wave monitor node 1B, and then refers to the association DB schematically shown in FIG. 12 to specify ID information regarding the surveillance camera 1A associated with the radio wave monitor node 1B of interest. Thereafter, the integrated control unit 109 refers to the captured image DB as shown in FIG. 14 to extract captured image data having a time stamp of the same time as a time stamp correlated with the extracted radio wave information data and having the specified ID information regarding the surveillance camera 1A. The processing allows the integrated control unit 109 to extract a captured image corresponding to a radio wave detected first during a search period designated by a user from a plurality of captured images.

Upon extracting captured image data in the above manner, the integrated control unit 109 causes a display screen as shown in FIG. 17 to be displayed on a display or the like of the information processing apparatus 10 in cooperation with the display control unit 111. On this display screen, a search result display area 201 in which search results of captured images are displayed and a captured image display area 203 in which a captured image designated by a user operation among search results are provided in addition to a search condition presenting area in which a search condition is presented. This search result display area 201 is an example of a specified result display area. In the search result display area 201, thumbnail images of extracted captured images are displayed as a list as schematically shown in FIG. 17, for example, a captured image corresponding to a thumbnail image selected with the position designating object obj is displayed in detail in the captured image display area 203.

Note that FIG. 17 shows a case where extracted captured images are displayed as a list in the search result display area 201, whilst search results may be provided for a user by a time line display as shown in FIG. 18. In this case, thumbnail images of captured images are arranged in a time line in accordance with time stamps correlated with the respective extracted captured images. In addition, in the time line, display objects 205 representing temporal positions at which radio wave information is detected are arranged together with the thumbnail images. Furthermore, for the captured image displayed in the captured image display area 201 by a user operation, a display object 207 representing a temporal position of a time stamp of the captured image is arranged.

A data structure of each type of database stored in the storage unit 105 and radio-wave-information analyzing processing in the information processing apparatus 10 according to the present embodiment have been described above in detail with reference to FIG. 11 to FIG. 18.

<Regarding Flow of Information Processing Method>

Figure 19:
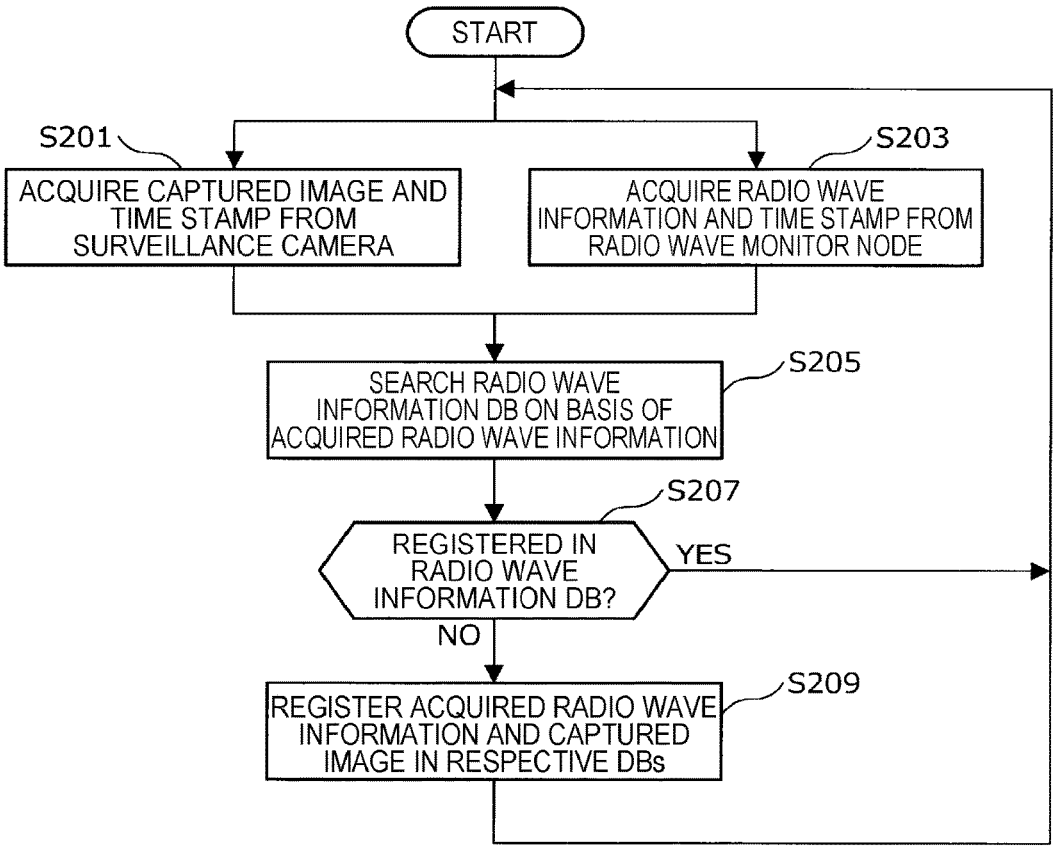
FIG. 19 is an explanatory diagram schematically showing an example of a display screen of the information processing apparatus according to the embodiment.
Figure 20:
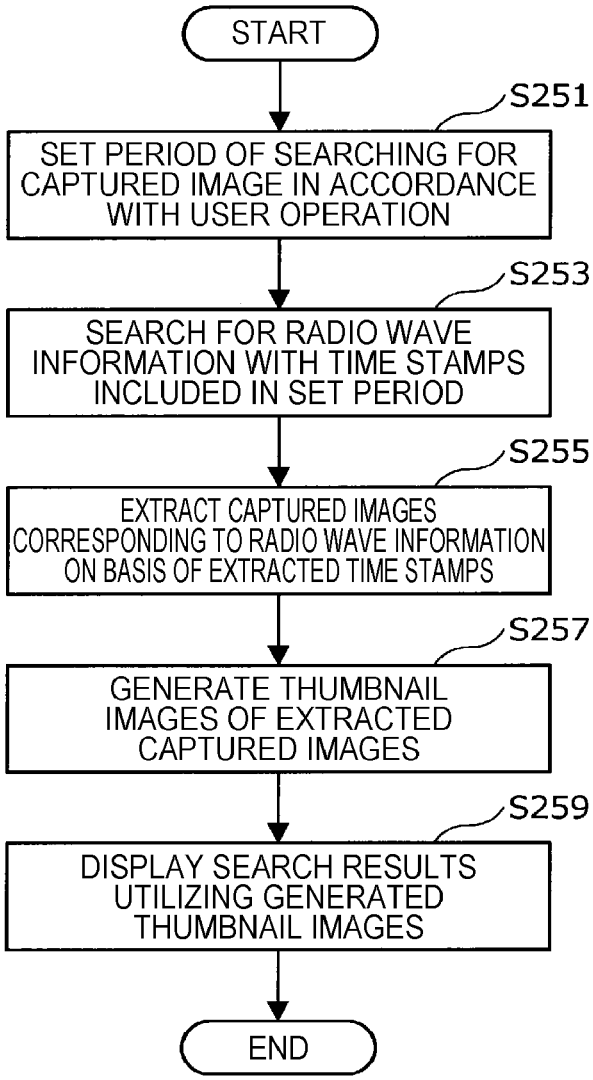
FIG. 20 is an explanatory diagram schematically showing an example of a display screen of the information processing apparatus according to the embodiment.

Next, an example of a flow of an information processing method carried out in the information processing apparatus 10 according to the present embodiment will be briefly described with reference to FIG. 19 and FIG. 20. FIG. 19 and FIG. 20 are flowcharts each showing an example of a flow of an information processing method according to the present embodiment.

In the information processing method according to the present embodiment, the data acquisition unit 101 of the information processing apparatus 10 acquires a captured image and a time stamp from the surveillance camera 1A (step S201), and acquires radio wave information and a time stamp from the radio wave monitor node 1B (step S203), as shown in FIG. 19.

When new radio wave information is acquired by the data acquisition unit 101, the analysis unit 107 searches the radio wave information DB stored in the storage unit 105 or the like on the basis of the newly acquired radio wave information (step S205).

In a case where the newly acquired radio wave information has been registered in the radio wave information DB, the information processing apparatus 10 returns to step S201 and step S203 to continue processing without registering the radio wave information and captured image having been acquired in the respective DBs. On the other hand, in a case where the newly acquired radio wave information has not been registered in the radio wave information DB, the analysis unit 107 causes the data recording unit 103 to record the radio wave information and captured image having been newly acquired to be registered in the respective DBs (step S209). Thereafter, the information processing apparatus 10 returns to step S201 and step S203 to continue processing.

When such processing is continued, a captured image corresponding to a radio wave detected first is accumulated in the information processing apparatus 10 together with radio wave information.

In a case where a search for an accumulated captured image has been indicated by a user operation, the integrated control unit 109 of the information processing apparatus 10 sets a period for searching for the captured image in accordance with a user operation (step S251). Thereafter, the integrated control unit 109 searches for radio wave information with time stamps included in the set period by the method as described earlier (step S253).

Thereafter, the integrated control unit 109 extracts captured images corresponding to radio wave information on the basis of the extracted time stamps by the method as described earlier (step S255). Subsequently, the integrated control unit 109 generates thumbnail images of the extracted captured images (step S257), and causes search results to be displayed on a display screen utilizing the generated thumbnail images in cooperation with the display control unit 111 (step S259).

When such processing is carried out, it is possible for a user of the information processing apparatus 10 to easily extract a captured image corresponding to a radio wave detected first during a certain specific period from a plurality of captured images.

The information processing apparatus and the information processing method according to the second embodiment of the present disclosure have been described above in detail.

(Third Embodiment)

An information processing apparatus according to a third embodiment of the present disclosure will be described below in detail with reference to FIG. 21 to FIG. 26.

Figure 21:
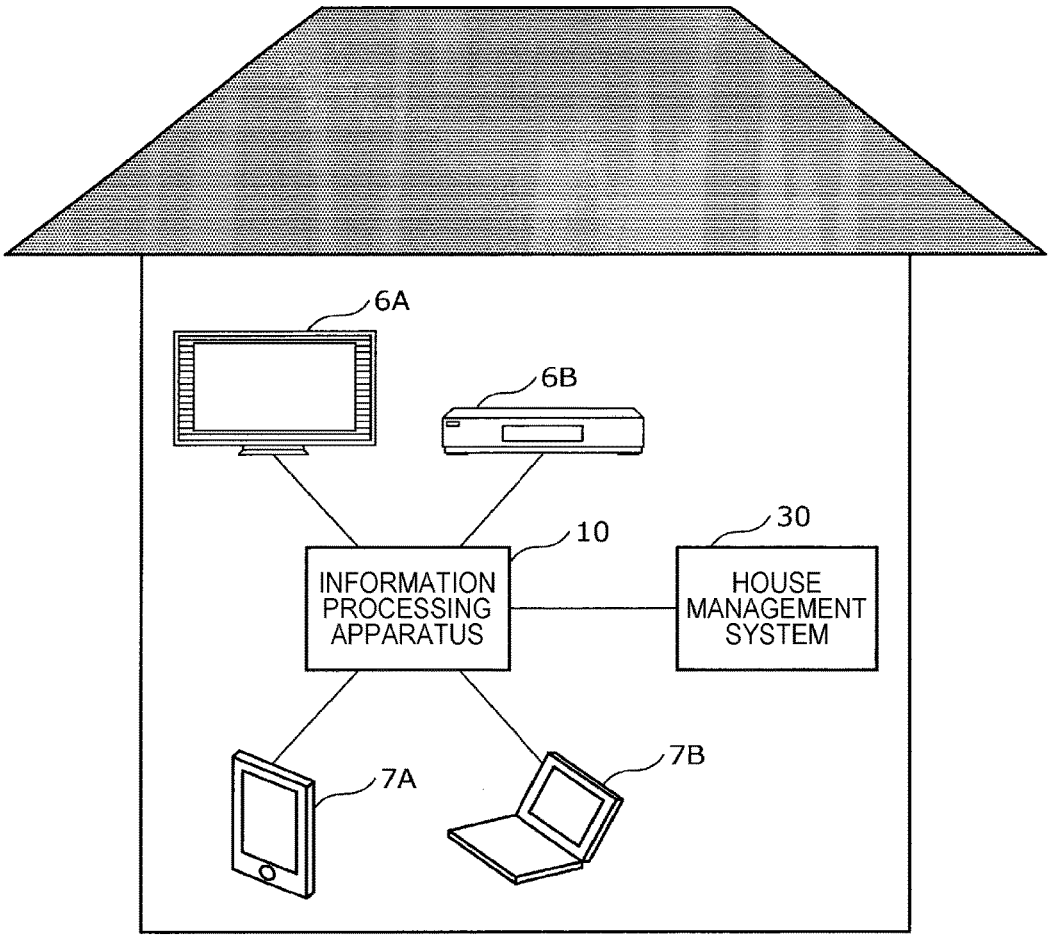
FIG. 21 is an explanatory diagram for describing an information processing apparatus according to a third embodiment of the present disclosure.
Figure 22:
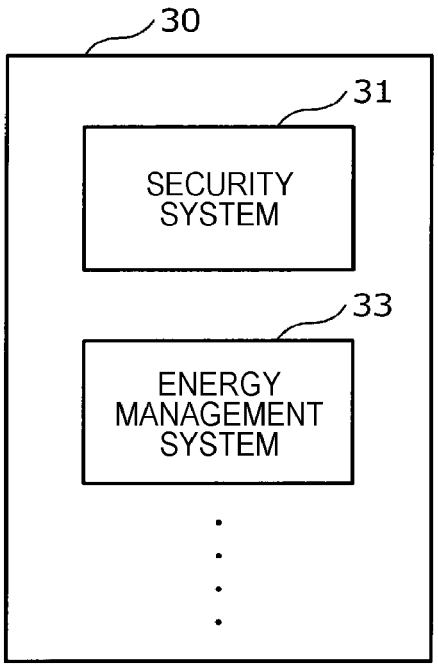
FIG. 22 is an explanatory diagram for describing a housing management system controlled by the information processing apparatus according to the embodiment.
Figure 25:
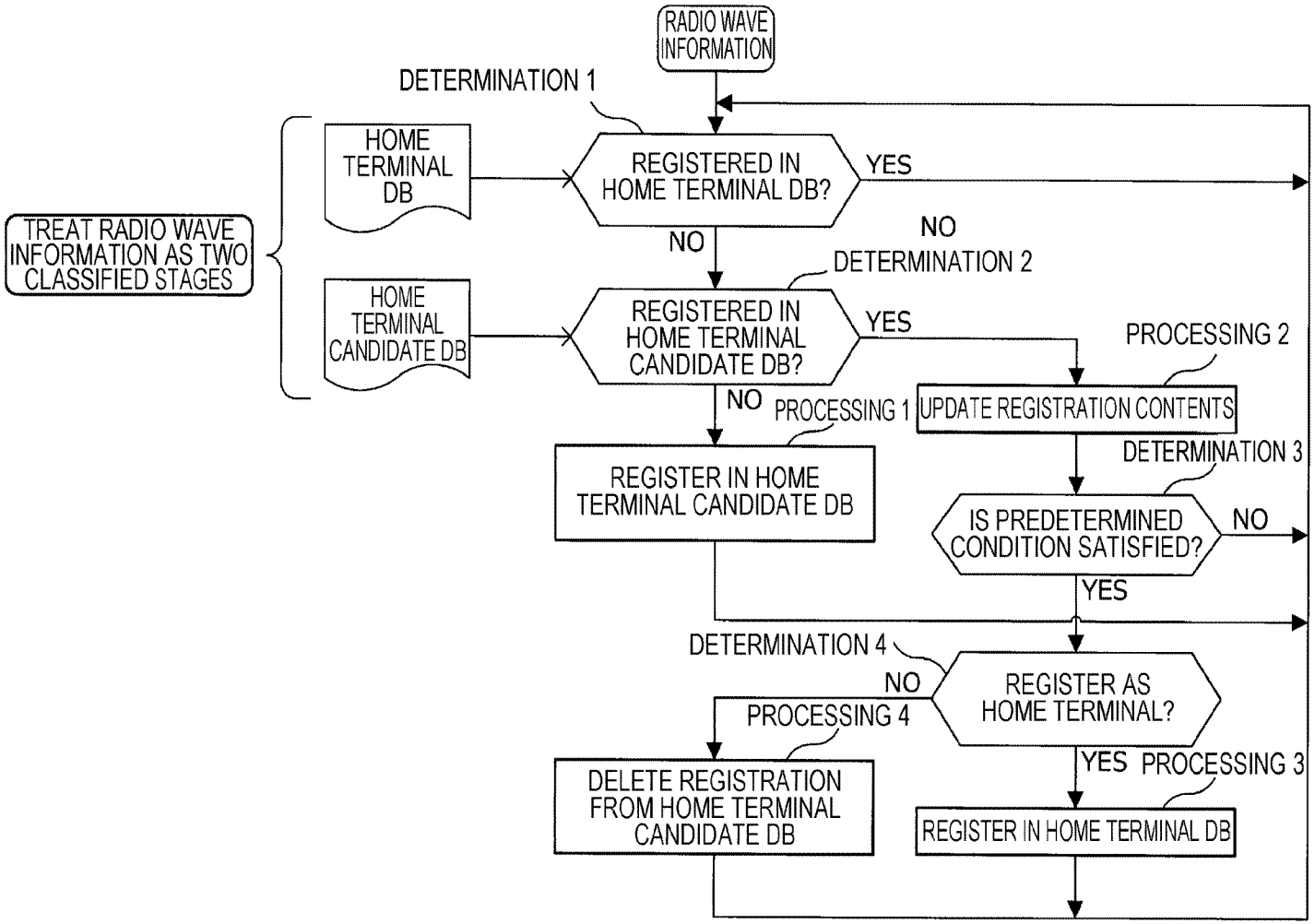
FIG. 25 is a flowchart for describing radio-wave-information analyzing processing carried out in the information processing apparatus according to the embodiment.
Figure 26:
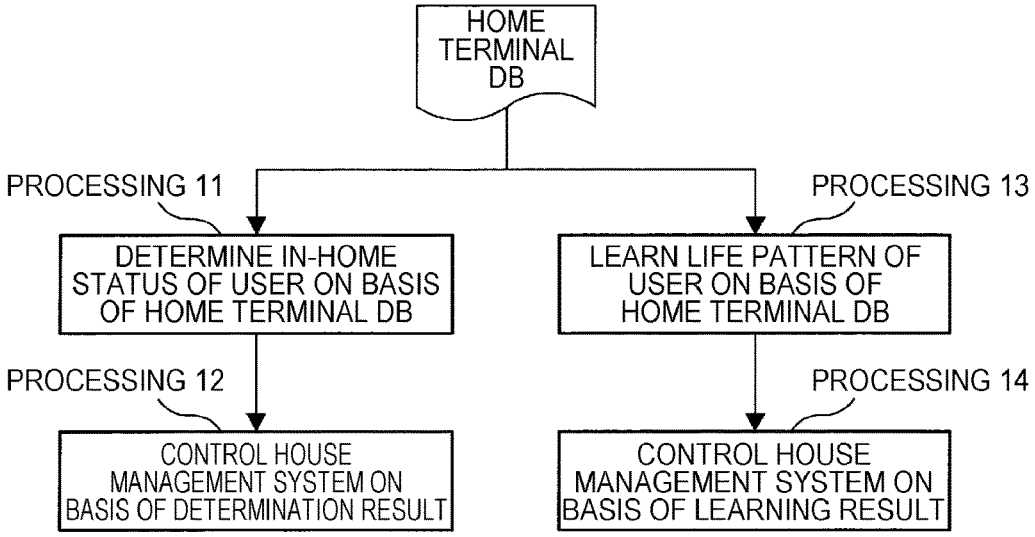
FIG. 26 is a flowchart for describing radio-wave-information analyzing processing carried out in the information processing apparatus according to the embodiment.

FIG. 21 is an explanatory diagram for describing the information processing apparatus according to the present embodiment. FIG. 22 is an explanatory diagram for describing a housing management system that the information processing apparatus according to the present embodiment controls. FIG. 23 is an explanatory diagram showing an example of a data structure of a home terminal database for use in the information processing apparatus according to the present embodiment, and FIG. 24 is an explanatory diagram showing an example of a data structure of a home terminal candidate database for use in the information processing apparatus according to the present embodiment. FIG. 25 and FIG. 26 are flowcharts for describing radio-wave-information analyzing processing carried out in the information processing apparatus according to the present embodiment.

<Regarding House Management Processing by Means of Radio Wave Information>

The information processing apparatus 10 according to the present embodiment has a configuration as shown in FIG. 2A or FIG. 2B, and is installed inside the house of a user. As schematically shown in FIG. 21, the information processing apparatus 10 according to the present embodiment detects radio waves emitted from an electronic appliance or a communication appliance installed in the house of the user or an electronic appliance or a communication appliance held by the user, and in accordance with a detection status of the radio waves, controls an operation state of a house management system 30 installed in the house of the user.

Electronic appliances and communication appliances that may exist in the house of the user can be broadly classified into appliances installed in the house, such as a television 6A and a digital recorder 6B, and appliances held by a user and thus carried to the outside of the house, such as a mobile phone, a smartphone/tablet terminal 7A, and a notebook personal computer 7B. The information processing apparatus 10 according to the present embodiment pays attention to home radio waves emitted from such an electronic appliance or communication appliance (hereinafter also referred to as a "home terminal") that may exist in the house of the user. Such home radio waves are radio waves that may exist on a daily basis in the house of the user.

The information processing apparatus 10 according to the present embodiment associates radio wave information concerning a home radio wave from a home terminal as shown in FIG. 21 with a time stamp, which are then saved in a database. Then, the information processing apparatus 10 according to the present embodiment pays attention to a radio wave from a home terminal held by a user and thus carried to the outside of the house. In a case where a user existing in the house goes out, in recent years, the user often carries a specific electronic appliance or communication appliance, such as a mobile phone, a smartphone, or a tablet terminal. Therefore, in the information processing apparatus 10 according to the present embodiment, a detection status of a radio wave of a predetermined terminal (for example, a mobile phone, a smartphone, a tablet terminal, or the like) among home terminals held by the user and thus carried to the outside of the house is always observed, and in a case where radio waves of these specific terminals have not been detected within a predetermined period, it is determined that the house is in a state where no one is present. The information processing apparatus 10 according to the present embodiment automatically determines whether the user is away from home or not on the basis of radio wave information, and then controls an operation state of the house management system 30 in accordance with the in-home status of the user.

Such a house management system 30 can include each type of the security system 31 that observes an intruder in the house and an energy management system 33, such as a smart grid, that manages supply/utilization of electric energy and the like in the house, as shown in FIG. 22, for example. Besides these systems, any system that manages the house of a user from some perspective may be a house management system whose operation state is managed by the information processing apparatus 10 according to the present embodiment. In the present embodiment, these house management systems 30 are capable of performing communication with the information processing apparatus 10 mutually via each type of network such as the Internet or LAN.

When determining that the user is away from home on the basis of a detection status of a radio wave from a specific home terminal, the information processing apparatus 10 according to the present embodiment can cause the security system 31 in the house management system 30 to transition to an absence mode which is an operation state at a higher level of security, for example. In addition, when determining that the user is absent, the information processing apparatus 10 according to the present embodiment can output a control signal for turning off a specific electric appliance to the energy management system 33 in the house management system 30, for example.

In addition, by learning a detection status of a radio wave of a specific home terminal carried by a user, it is possible for the information processing apparatus 10 according to the present embodiment to estimate a time slot in which the user is away from the house and a time slot in which the user is at home. The information processing apparatus 10 according to the present embodiment is capable of operating a predetermined function of the house management system 30 on the basis of learning results of such a user's life pattern. For example, it is possible for the information processing apparatus 10 according to the present embodiment to exert control such as controlling the energy management system 33 in the house management system 30 on the basis of learning results of a user's life pattern to turn on lighting equipment and air-conditioning equipment in agreement with the time when the user is supposed to return home.

In this manner, it is possible for the information processing apparatus 10 according to the present embodiment to manage the house of a user on the basis of radio wave information from a specific appliance.

<Regarding Radio-wave-information Analyzing Processing>

Hereinafter, focusing attention to a data structure of each type of database stored in the storage unit 105 as well as detailed functions of the analysis unit 107 and the integrated control unit 109 according to the present embodiment, radio-wave-information analyzing processing in the information processing apparatus 10 according to the present embodiment will be described in detail.

[Regarding Data Structure of Each Type of Database]

First, an example of a data structure of each type of database stored in the storage unit 105 according to the present embodiment will be described specifically with reference to FIG. 23 and FIG. 24.

FIG. 23 shows an example of a data structure of a DB (hereinafter simply referred to as a "home terminal DB" as well) concerning a home terminal existing in the house of a user. As schematically shown in FIG. 23, in the home terminal DB, radio wave information data emitted from a certain home terminal (or information indicating a storage location of the radio wave information data) has been recorded in correlation with identification information (ID information) specific to the home terminal having emitted the radio wave information. In addition, in the home terminal DB, a time stamp showing a time when each piece of recorded radio wave information is registered first, a time stamp showing a time when the radio wave information is detected previously, an operating status of the home terminal (whether it is operating or not), and the like have been associated.

Here, registered radio wave information data may have any data structure as long as feature values that characterize an observed radio wave, such as ID information specific to the observed radio wave and an electric field intensity, have been described. In the radio wave information, identification information such as a MAC address which is information specific to an observed individual radio wave, the electric field intensity of a radio wave, and the like have been described, for example. In addition, besides these feature values, any feature values that characterize an observed radio wave may have been described. A data structure of the radio wave information data is not particularly limited, but any data structure may be adopted.

The type of ID information recorded in the home terminal DB as described above and the ID information describing method are not particularly limited, but it is possible to utilize any type and any describing method which are publicly known as necessary. In addition, the method of describing time stamps is also not particularly limited, but time stamps may be expressed utilizing any describing method as necessary.

Note that, in addition to various types of information as described above, various types of information related to a radio wave emitted from the home terminal may have been recorded in the home terminal DB.

In addition, a terminal not registered in the home terminal DB may be brought into the house, such as by having a visitor holding an electronic appliance or the like, or newly purchasing an electronic appliance or the like. It is possible to treat an electronic appliance or the like emitting such radio wave information not registered in the home terminal DB as a candidate for a new home terminal. Therefore, as schematically shown in FIG. 24, the information processing apparatus 10 according to the present embodiment creates a database (hereinafter simply referred to as a "home terminal candidate DB" as well) concerning radio wave information from an appliance registered as a candidate for a home terminal.

An example of a data structure of the home terminal candidate DB stored in the storage unit 105 or the like is shown in FIG. 24. As schematically shown in FIG. 24, in the home terminal candidate DB, radio wave information data emitted from an electronic appliance, a communication appliance, or the like existing in the house but not registered as a home terminal (or information indicating a storage location of the radio wave information data) have been recorded in correlation with identification information (ID information) specific to the appliance emitting the radio wave information. In addition, a time stamp showing a time when the radio wave information is detected first, a time stamp showing a time when the radio wave information is detected previously, and the like have been associated with each piece of radio wave information, and information representing the number of times of detection or the like has also been associated. Note that, in addition to various types of information as described above, various types of information related to a radio wave emitted from an electronic appliance, a communication appliance, or the like existing in the house but not registered as a home terminal may have been recorded in the home terminal candidate DB.

By referring to databases having data structures as shown in FIG. 23 and FIG. 24 at any time, it is possible for the analysis unit 107 and the integrated control unit 109 of the information processing apparatus 10 according to the present embodiment to easily grasp various types of information concerning a radio wave from a home terminal.

[Regarding Specific Functions of the Analysis Unit 107 and the Integrated Control Unit 109]

Subsequently, specific functions of the analysis unit 107 and the integrated control unit 109 that the information processing apparatus 10 according to the present embodiment has will be described in detail with reference to FIG. 25 to FIG. 26.

The analysis unit 107 and the integrated control unit 109 according to the present embodiment treat newly acquired radio wave information as two classified stages of (1) radio wave information from a candidate for a home terminal and (2) radio wave information from a home terminal. That is, the analysis unit 107 and the integrated control unit 109 according to the present embodiment treat radio wave information which is not radio wave information regarding a known home terminal as radio wave information from a candidate for a home terminal, and newly treat radio wave information that satisfies a predetermined condition among pieces of radio wave information included in a candidate for a home terminal as radio wave information from a home terminal.

As schematically shown in FIG. 25, when radio wave information is newly acquired, the analysis unit 107 of the information processing apparatus 10 according to the present embodiment refers to the home terminal DB stored in the storage unit 105 or the like to determine whether radio wave information of interest has already been registered in the home terminal DB (determination 1). In a case where the radio wave information of interest has already been registered in the home terminal DB, the analysis unit 107 updates registration contents (for example, a time stamp or the like) of the radio wave information in the home terminal DB, and then waits for acquisition of new radio wave information.

On the other hand, in a case where the radio wave information of interest has not been registered in the home terminal DB, the analysis unit 107 refers to the home terminal candidate DB stored in the storage unit 105 or the like to determine whether the radio wave information of interest has been registered in the home terminal candidate DB (determination 2). In a case where the radio wave information of interest has not been registered in the home terminal candidate DB, the analysis unit 107 causes the radio wave information of interest to be registered in the home terminal candidate DB in cooperation with the data recording unit 103 (processing 1).

On the other hand, in a case where the radio wave information of interest has already been registered in the home terminal candidate DB, the analysis unit 107 updates registration contents of a time stamp, the number of times of detection, and the like, for example (processing 2). Thereafter, the analysis unit 107 determines whether the radio wave information of interest having already been registered in the home terminal candidate DB satisfies a predetermined condition or not (determination 3). In a case where a predetermined condition is not satisfied, the analysis unit 107 waits for acquisition of new radio wave information.

On the other hand, in a case where a predetermined condition is satisfied, the analysis unit 107 asks a user to determine whether or not to newly register a terminal corresponding to the radio wave information of interest as a home terminal, in cooperation with the display control unit 111 and the like. In a case where a user operation of newly registering as a home terminal has been performed, the analysis unit 107 deletes the radio wave information from the home terminal candidate DB, and then registers the radio wave information in the home terminal DB (processing 3). On the other hand, in a case where a user operation of not newly registering as a home terminal has been performed, the analysis unit 107 deletes registration of the radio wave information from the home terminal candidate DB (processing 4). Thereafter, the analysis unit 107 waits for acquisition of new radio wave information.

Here, a predetermined condition as described above is not particularly limited, but may be set as necessary as "detection of the radio wave by a predetermined number of times or more within a predetermined period" or the like, for example. The analysis unit 107 may refer to registration contents of the home terminal candidate DB to determine whether a condition as described above is satisfied or not from the registration contents.

When processing as described above is performed by the analysis unit 107, a database concerning a home terminal existing in the house of a user is automatically updated.

Utilizing the home terminal DB created in this manner, it is possible for the analysis unit 107 and the integrated control unit 109 to perform processing as shown in FIG. 26.

First, by determining whether a radio wave of a specific home terminal defined in advance has not been detected within a predetermined time or not utilizing the home terminal DB, the analysis unit 107 can determine the in-home status of the user (processing 11). As described before, in recent years, a communication appliance, such as a mobile phone or a smartphone, is highly likely to be brought out of the house with a user. Therefore, it is possible to determine the in-home status of the user by observing a detection status of a radio wave from such a communication appliance. In a case where a home terminal to be brought out of the house with a user is set in advance as a terminal to be observed, and radio waves from all terminals to be observed have not been detected within a predetermined period (that can be set in advance by a user, such as 10 minutes or 20 minutes, for example), the analysis unit 107 can determine that none of the users stays at home, and are in the state away from home.

When it is determined by the analysis unit 107 that the house is in the state where no one is present, the integrated control unit 109 can control an operation state of the house management system 30 on the basis of the determination result (processing 12). Specifically, the integrated control unit 109 can cause the security system 31 in the house management system 30 to transition to the absence mode, and can control the energy management system 33 to turn off specific electrical appliances (such as a home cooking appliance and air-conditioning equipment, for example).

In addition, by performing publicly-known machine learning processing or the like utilizing the created home terminal DB, the analysis unit 107 can learn a user's life pattern (processing 13). Accordingly, it is possible to estimate a time when the user is usually at home.

Utilizing learning results of such a life pattern, the integrated control unit 109 can control an operation state of the housing management system 30 (processing 14). Specifically, it is possible for the integrated control unit 109 to exert control such as controlling the energy management system 33 in a time slot in which the user is supposed to return home on the basis of the user's life pattern obtained as a result of learning to turn on specific electrical appliances (such as lighting equipment and air-conditioning equipment, for example).

A data structure of each type of database stored in the storage unit 105 and radio-wave-information analyzing processing in the information processing apparatus 10 according to the present embodiment have been described above in detail with reference to FIG. 21 to FIG. 26.

<Regarding Flow of Information Processing Method>

Figure 27:
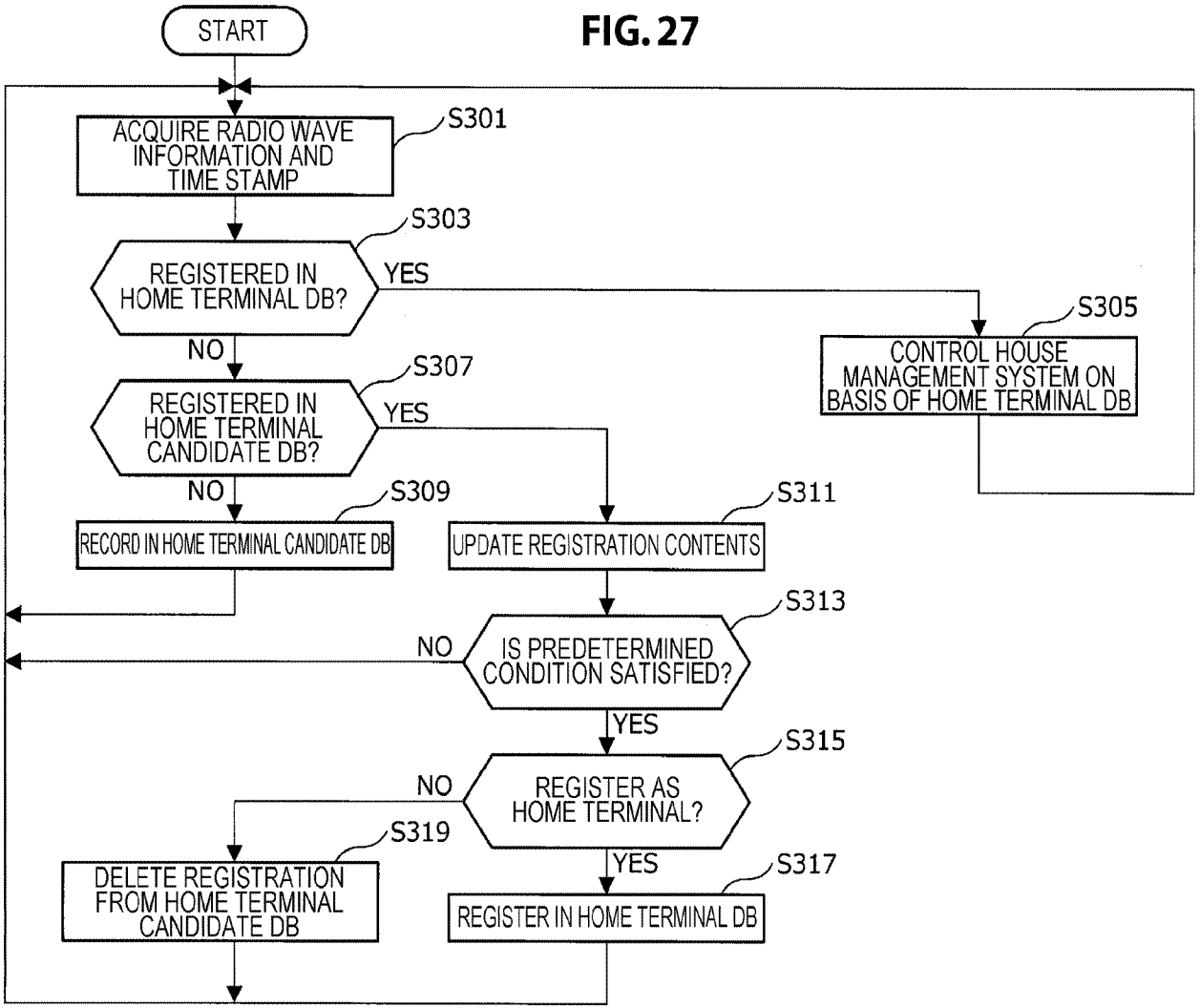
FIG. 27 is a flowchart showing an example of a flow of an information processing method according to the embodiment.

Next, an example of a flow of an information processing method carried out in the information processing apparatus 10 according to the present embodiment will be briefly described with reference to FIG. 27. FIG. 27 is a flowchart showing an example of a flow of an information processing method according to the present embodiment.

In the information processing method according to the present embodiment, radio wave information and a time stamp are acquired at any time by the data acquisition unit 101 (step S301).

When new radio wave information is acquired by the data acquisition unit 101, the analysis unit 107 determines whether the newly acquired radio wave information has already been registered in the home terminal DB stored in the storage unit 105 or the like (step S303). In a case where the newly acquired radio wave information has already been registered in the home terminal DB, the analysis unit 107 and the integrated control unit 109 control an operation state of the house management system 30 on the basis of the home terminal DB (step S305).

On the other hand, in a case where the newly acquired radio wave information has not been registered in the home terminal DB, the analysis unit 107 refers to the home terminal candidate DB stored in the storage unit 105 or the like to determine whether the newly acquired radio wave information has already been registered in the home terminal candidate DB (step S307). In a case where the newly acquired radio wave information has not been registered in the home terminal candidate DB, the analysis unit 107 causes the data recording unit 103 to record the newly acquired radio wave information in the home terminal candidate DB (step S309).

On the other hand, in a case where the newly acquired radio wave information has been registered in the home terminal candidate DB, the analysis unit 107 updates registration contents of the home terminal candidate DB (step S311).

Thereafter, the analysis unit 107 determines whether each piece of radio wave information registered in the home terminal candidate DB satisfies a predetermined condition or not (step S313). In a case where radio wave information that satisfies a predetermined condition exists, the analysis unit 107 inquires of a user whether or not to register as a home terminal in cooperation with the display control unit 111 and the like to determine a user operation performed (step S315). In a case where a user operation of registering as a home terminal has been performed, the analysis unit 107 deletes the radio wave information from the home terminal candidate DB, and then registers the relevant radio wave information in the home terminal DB (step S317). Alternatively, in a case where a user operation of not registering as a home terminal has been performed, the analysis unit 107 deletes the radio wave information from the home terminal candidate DB (step S319).

When such processing is carried out, it is possible for the information processing apparatus 10 to automatically control an operation state of a system that manages a house on the basis of radio wave information.

The information processing apparatus and the information processing method according to the third embodiment of the present disclosure have been described above in detail.

(Regarding Hardware Configuration)

Figure 28:
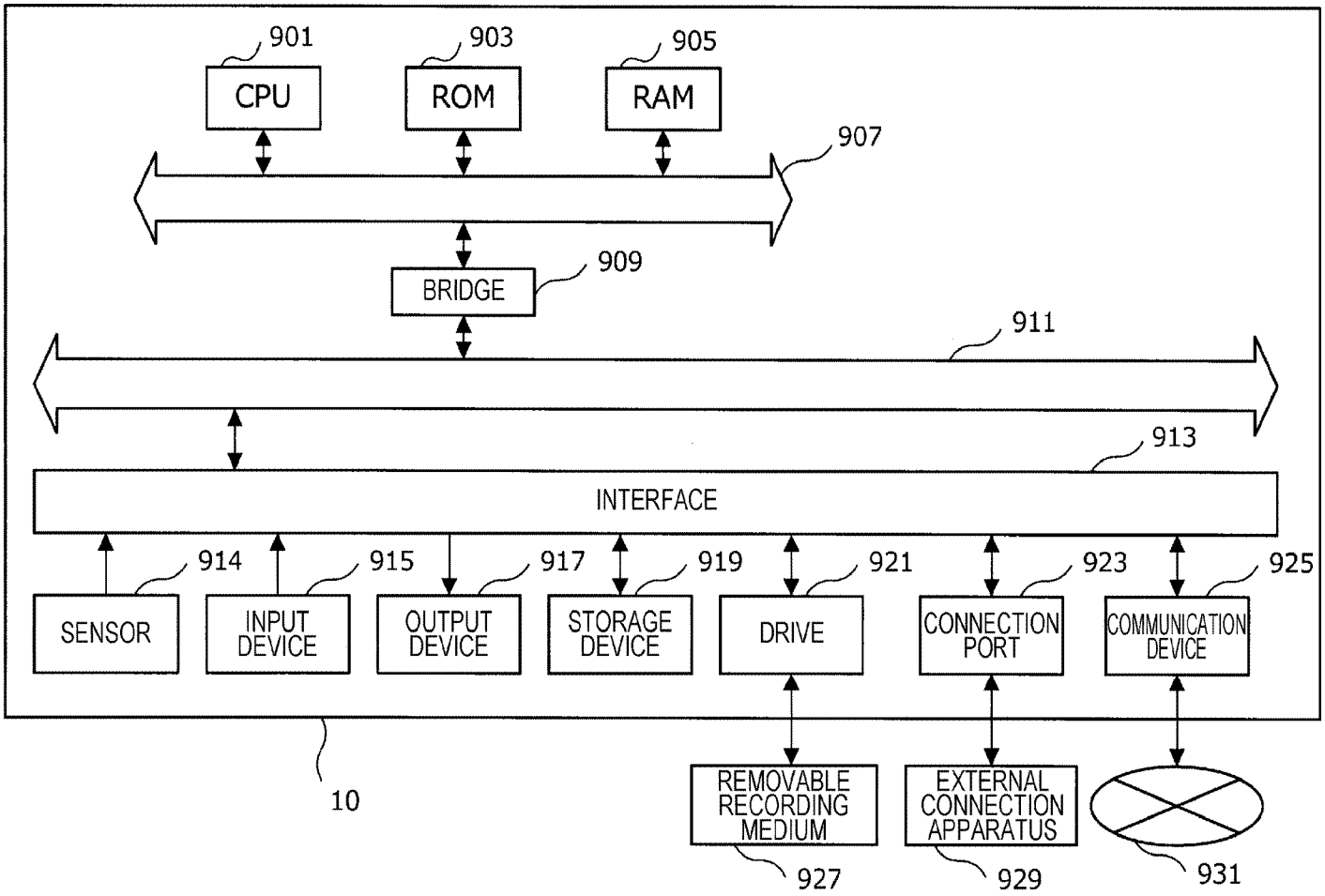
FIG. 28 is a block diagram showing an example of a hardware configuration of an information processing apparatus according to each embodiment of the present disclosure.

Next, the hardware configuration of the information processing apparatus 10 according to the embodiment of the present disclosure will be described in detail with reference to FIG. 28. FIG. 28 is a block diagram for describing the hardware configuration of the information processing apparatus 10 according to the embodiment of the present disclosure.

The information processing apparatus 10 mainly includes a CPU 901, a ROM 903, and a RAM 905. Furthermore, the information processing apparatus 10 also includes a host bus 907, a bridge 909, an external bus 911, an interface 913, a sensor 914, an input device 915, an output device 917, a storage device 919, a drive 921, a connection port 923, and a communication device 925.

The CPU 901 serves as an arithmetic processing apparatus and a control apparatus, and controls the overall operation or a part of the operation of the information processing apparatus 10 according to various programs recorded in the ROM 903, the RAM 905, the storage device 919, or a removable recording medium 927. The ROM 903 stores programs, operation parameters, and the like used by the CPU 901. The RAM 905 primarily stores programs used the CPU 901 and parameters and the like varying as appropriate during the execution of the programs. These are connected with each other via the host bus 907 including an internal bus such as a CPU bus.

The host bus 907 is connected to the external bus 911 such as a PCI (Peripheral Component Interconnect/Interface) bus via the bridge 909.

The sensor 914 is a means for detecting various radio waves, such as various radio wave sensors or antennas. Moreover, in addition to the foregoing, the sensor 914 may have a detection means, such as a sensor that senses movements of a user, a sensor that acquires information representing a current position. Examples of such sensors can include a motion sensor, such as a triaxial acceleration sensor including an acceleration sensor, a gravity sensing sensor, a drop detection sensor, and the like or a triaxial gyro sensor including an angular velocity sensor, a shake correction sensor, a geomagnetic sensor, and the like, a GPS sensor, and the like. Further, in addition to the foregoing, the sensor 914 may also include various types of measuring equipment, such as a thermometer, an illuminance meter, and a hygrometer.

The input device 915 is an operation means operated by a user, such as a mouse, a keyboard, a touch panel, buttons, a switch and a lever, for example. Also, the input device 915 may be a remote control means (a so-called remote controller) using, for example, infrared light or other radio waves, or may be an external connection apparatus 929 such as a mobile phone or a PDA conforming to the operation of the information processing apparatus 10. Furthermore, the input device 915 generates an input signal on the basis of, for example, information which is input by a user with the above operation means, and includes an input control circuit or the like for outputting the input signal to the CPU 901. The user of the information processing apparatus 10 can input various data to the information processing apparatus 10 and can instruct the information processing apparatus 10 to perform various types of processing by operating this input device 915.

The output device 917 includes a device capable of visually or audibly notifying a user of acquired information. Such a device includes a display device such as a CRT display device, a liquid crystal display device, a plasma display device, an EL display device and a lamp, an audio output device such as a speaker and a headphone, a printer, a mobile phone, a facsimile machine, and the like. For example, the output device 917 outputs a result obtained by various types of processing performed by the information processing apparatus 10. Specifically, the display device displays, in the form of text or images, a result obtained by various types of processing performed by the information processing apparatus 10. On the other hand, the audio output device converts an audio signal including reproduced audio data, sound data, and the like into an analog signal, and outputs the analog signal.

The storage device 919 is a device for storing data configured as an example of a storage unit of the information processing apparatus 10. The storage device 919 includes, for example, a magnetic storage device such as a HDD (Hard Disk Drive), a semiconductor storage device, an optical storage device, a magneto-optical storage device, or the like. This storage device 919 stores programs to be executed by the CPU 901 and various types of data, externally obtained various types of data, and the like.

The drive 921 is a reader/writer for a recording medium, and is built in the information processing apparatus 10 or attached externally thereto. The drive 921 reads information recorded in the attached removable recording medium 927 such as a magnetic disk, an optical disc, a magneto-optical disk, or a semiconductor memory, and outputs the read information to the RAM 905. Furthermore, the drive 921 can write records in the attached removable recording medium 927 such as a magnetic disk, an optical disc, a magneto-optical disk, or a semiconductor memory. The removable recording medium 927 is, for example, a DVD medium, an HD-DVD medium, a Blu-ray (registered trademark) medium, or the like. In addition, the removable recording medium 927 may be a CompactFlash (CF; registered trademark), a flash memory, an SD memory card (Secure Digital Memory Card), or the like. Further, the removable recording medium 927 may be, for example, an IC card (Integrated Circuit Card) equipped with a non-contact IC chip, an electronic appliance, or the like.

The connection port 923 is a port for allowing devices to directly connect to the information processing apparatus 10. Examples of the connection port 923 include a USB (Universal Serial Bus) port, an IEEE1394 port, a SCSI (Small Computer System Interface) port, and the like. Other examples of the connection port 923 include an RS-232C port, an optical audio terminal, a High-Definition Multimedia Interface (HDMI, registered trademark) port, and the like. By connecting the external connection apparatus 929 to this connection port 923, the information processing apparatus 10 directly acquires various types of data from the external connection apparatus 929 and provides various types of data to the external connection apparatus 929.

The communication device 925 is a communication interface including, for example, a communication device or the like for connecting to a communication network 931. The communication device 925 is, for example, a communication card or the like for a wired or wireless LAN (Local Area Network), Bluetooth (registered trademark), or WUSB (Wireless USB). Further, the communication device 925 may be a router for optical communication, a router for ADSL (Asymmetric Digital Subscriber Line), a modem for various types of communication, or the like. This communication device 925 can transmit and receive signals and the like in accordance with a predetermined protocol, for example, such as TCP/IP on the Internet and with other communication devices, for example. In addition, the communication network 931 connected to the communication device 925 includes a network and the like which is connected in a wire or wireless manner, and may be, for example, the Internet, a home LAN, infrared communication, radio wave communication, satellite communication, or the like.

The above illustrates an example of the hardware configuration capable of realizing the functions of the information processing apparatus 10 according to the embodiment of the present disclosure. Each of the above structural elements may be realized using a general-purpose members, or may also be realized using hardware specialized in the function of each structural element. Consequently, it is possible to appropriately modify the hardware configuration to be used according to the technical level at the time of carrying out the present embodiment.

The preferred embodiment(s) of the present disclosure has/have been described above with reference to the accompanying drawings, whilst the present disclosure is not limited to the above examples. A person skilled in the art may find various alterations and modifications within the scope of the appended claims, and it should be understood that they will naturally come under the technical scope of the present disclosure.

Further, the effects described in this specification are merely illustrative or exemplified effects, and are not limitative. That is, with or in the place of the above effects, the technology according to the present disclosure may achieve other effects that are clear to those skilled in the art from the description of this specification.

Additionally, the present technology may also be configured as below. Here, the following control unit corresponds to the analysis unit and the integrated control unit described earlier.

(1)

An information processing apparatus including:

a control unit configured to control processing of recording radio wave information concerning a radio wave observed in a predetermined environment and related information related to the radio wave information in association with each other, comparing the newly acquired radio wave information and the recorded radio wave information, and in a case where a result of comparison satisfies a predetermined condition, providing a user with a predetermined function on a basis of related information related to the newly acquired radio wave information.

(2)

The information processing apparatus according to (1), in which the radio wave is a radio wave emitted around an electronic appliance or a communication appliance held by the user, the recorded radio wave information is obtained by associating the radio wave information acquired from a range of daily activities of the user with at least one of positional information showing a position where the radio wave information is acquired as the related information and information concerning a time stamp at which the radio wave information is acquired, and the control unit, in a case where the newly acquired radio wave information is not the recorded radio wave information, records the newly acquired radio wave information as a candidate for suspicious-person radio wave information which is the radio wave information emitted from an electronic appliance or a communication appliance held by a suspicious person, and in a case where the recorded candidate for the suspicious-person radio wave information is detected as satisfying a predetermined condition, records the candidate for suspicious-person radio wave information that satisfies the predetermined condition as the new suspicious-person radio wave information, and in a case where the newly acquired radio wave information is radio wave information corresponding to the suspicious-person radio wave information, issues a warning to the user.

(3)

The information processing apparatus according to (2), in which the control unit, whenever the radio wave information corresponding to the candidate for the suspicious-person radio wave information is detected, increases an evaluation value of the candidate for the suspicious-person radio wave information, and in a case where the radio wave information corresponding to the candidate for the suspicious-person radio wave information is detected a predetermined number of times or more within a predetermined period and the evaluation value of the candidate for the suspicious-person radio wave information arrives at a predetermined threshold value or higher, records the candidate for the suspicious-person radio wave information as the new suspicious-person radio wave information.

(4)

The information processing apparatus according to (2) or (3), in which the control unit, in a case where the candidate for the suspicious-person radio wave information is recorded, presents an inquiry to the user regarding whether to treat the recorded candidate for the suspicious-person radio wave information as the new suspicious-person radio wave information, and in a case where an input indicating that the recorded candidate for the suspicious-person radio wave information is treated as the new suspicious-person radio wave information is performed by the user, records the recorded candidate for the suspicious-person radio wave information as the new suspicious-person radio wave information.

(5)

The information processing apparatus according to any one of (2) to (4), in which the control unit learns a range of daily activities of the user on a basis of the newly acquired radio wave information, and in a case where an existing position of the user is not included in the range of daily activities of the user and the radio wave information corresponding to the candidate for the suspicious-person radio wave information is detected, records the candidate for the suspicious-person radio wave information as the new suspicious-person radio wave information.

(6)

The information processing apparatus according to any one of (2) to (5), in which in a case where an existing position of the user is changing at a speed of a predetermined threshold value or higher, the control unit determines that the user is moving in a vehicle, and stops recording the suspicious-person radio wave information.

(7)

The information processing apparatus according to any one of (2) to (6), in which the control unit ranks the suspicious-person radio wave information in accordance with at least one of a detection status of the suspicious-person radio wave information and an evaluation result of the suspicious-person radio wave information performed by the user, and controls timing of the warning in accordance with ranking of the suspicious-person radio wave information.

(8)

The information processing apparatus according to any one of (2) to (7), in which further utilizing information registered on a network, the control unit analyzes the candidate for the suspicious-person radio wave information and the suspicious-person radio wave information.

(9)

The information processing apparatus according to any one of (2) to (8), in which the control unit causes a detection status of at least one of the candidate for the suspicious-person radio wave information and the suspicious-person radio wave information to be displayed in a time line or on a map utilizing the related information associated with the information.

(10)

The information processing apparatus according to (1), in which the radio wave is a radio wave emitted from an imaging device installed at a predetermined position or a communication appliance associated in advance with the imaging device and detected by the imaging device or the communication appliance, data concerning a captured image generated by the imaging device installed at the predetermined position is stored in a predetermined storage location in association with a time stamp concerning the captured image, and the control unit compares the newly acquired radio wave information and the recorded radio wave information to analyze whether the newly acquired radio wave information has already been recorded, and in a case where the newly acquired radio wave information has not been recorded, records the newly acquired radio wave information as the related information in association with information concerning a time stamp of the radio wave information, and refers to the information concerning the time stamp associated with the newly recorded radio wave information to specify data concerning the captured image corresponding to a designated time stamp from data concerning the captured image stored in the predetermined storage location, and provides the user with information concerning the specified captured image.

(11)

The information processing apparatus according to (10), in which the control unit causes a time stamp of the newly recorded radio wave information corresponding to the captured image and a thumbnail image concerning the captured image to be displayed on a display screen as information concerning the captured image.

(12)

The information processing apparatus according to (11), in which the control unit generates, as the display screen, a specified result display area in which a result of specifying the captured images is to be displayed and a captured image display area in which the captured image designated by a user operation among the specified captured images is to be displayed, and causes a display object representing a temporal position of a time stamp of the newly added radio wave information, a thumbnail image of the captured image corresponding to the time stamp of the newly added radio wave information, and a display object representing a temporal position of a time stamp of the captured image displayed in the captured image display area to be displayed in the specified result display area.

(13)

The information processing apparatus according to (1), in which the radio wave is a home radio wave emitted from an electronic appliance of a communication appliance installed in a house of the user or an electronic appliance or a communication appliance held by the user, the recorded radio wave information is obtained by associating home radio wave information concerning the home radio wave with information concerning a time stamp at which the home radio wave information is acquired as the related information, and the control unit associates the newly acquired radio wave information and the home radio wave information, and analyzes whether the newly acquired radio wave information is the home radio wave information, and in a case where predetermined all pieces of the home radio wave information are not detected within a predetermined period, operates a system configured to manage the house.

(14)

The information processing apparatus according to (13), in which the control unit, in a case where the newly acquired radio wave information is not the home radio wave information, selects the newly acquired radio wave information as a candidate for the home radio wave information to be added, and in a case where the radio wave information corresponding to the candidate for the home radio wave information satisfies a predetermined condition within a predetermined period, records the radio wave information corresponding to the candidate for the home radio wave information as the new home radio wave information.

(15)

The information processing apparatus according to (13) or (14), in which the control unit machine-learns a life pattern of the user on a basis of the detected home radio wave information, and operates a predetermined function of the system configured to manage the house on a basis of a learning result of the life pattern of the user.

(16)

The information processing apparatus according to any one of (13) to (15), in which the system configured to manage the house is at least one of a security system for the house and an energy management system for the house.

(17)

The information processing apparatus according to any one of (1) to (16), in which the radio wave is a radio wave utilized in wireless communication.

(18)

The information processing apparatus according to any one of (1) to (17), further including:

a radio wave detection unit configured to acquire the radio wave information.

(19)

An information processing method including:

controlling processing of recording radio wave information concerning a radio wave observed in a predetermined environment and related information related to the radio wave information in association with each other, comparing the newly acquired radio wave information and the recorded radio wave information, and in a case where a result of comparison satisfies a predetermined condition, providing a user with a predetermined function on a basis of related information related to the newly acquired radio wave information.

(20)

A program for causing a computer to achieve a function of controlling processing of recording radio wave information concerning a radio wave observed in a predetermined environment and related information related to the radio wave information in association with each other, comparing the newly acquired radio wave information and the recorded radio wave information, and in a case where a result of comparison satisfies a predetermined condition, providing a user with a predetermined function on a basis of related information related to the newly acquired radio wave information.

REFERENCE SIGNS LIST

10 information processing apparatus
101 data acquisition unit
103 data recording unit
105 storage unit
107 analysis unit
109 integrated control unit
111 display control unit
113 radio wave detection unit

The invention claimed is:

1. An information processing apparatus comprising:

control circuitry configured to control processing of recording radio wave information concerning a radio wave observed in a predetermined environment and related information related to the radio wave information in association with each other, comparing the newly acquired radio wave information and the recorded radio wave information, and in a case where a result of comparison satisfies a predetermined condition, providing a user with a predetermined function on a basis of related information related to the newly acquired radio wave information;

wherein the radio wave is a radio wave emitted around an electronic appliance or a communication appliance held by the user, the recorded radio wave information is obtained by associating the radio wave information acquired from a range of daily activities of the user with at least one of positional information showing a position where the radio wave information is acquired as the related information and information concerning a time stamp at which the radio wave information is acquired, and the control circuitry, in a case where the newly acquired radio wave information is not the recorded radio wave information, records the newly acquired radio wave information as a candidate for suspicious-person radio wave information which is the radio wave information emitted from an electronic appliance or a communication appliance held by a suspicious person, and in a case where the recorded candidate for the suspicious-person radio wave information is detected as satisfying a predetermined condition, records the candidate for suspicious-person radio wave information that satisfies the predetermined condition as the new suspicious-person radio wave information, and in a case where the newly acquired radio wave information is radio wave information corresponding to the suspicious-person radio wave information, issues a warning to the user.

2. The information processing apparatus according to claim 1, wherein the control circuitry, whenever the radio wave information corresponding to the candidate for the suspicious-person radio wave information is detected, increases an evaluation value of the candidate for the suspicious-person radio wave information, and in a case where the radio wave information corresponding to the candidate for the suspicious-person radio wave information is detected a predetermined number of times or more within a predetermined period and the evaluation value of the candidate for the suspicious-person radio wave information arrives at a predetermined threshold value or higher, records the candidate for the suspicious-person radio wave information as the new suspicious-person radio wave information.

3. The information processing apparatus according to claim 1, wherein the control circuitry, in a case where the candidate for the suspicious-person radio wave information is recorded, presents an inquiry to the user regarding whether to treat the recorded candidate for the suspicious-person radio wave information as the new suspicious-person radio wave information, and in a case where an input indicating that the recorded candidate for the suspicious-person radio wave information is treated as the new suspicious-person radio wave information is performed by the user, records the recorded candidate for the suspicious-person radio wave information as the new suspicious-person radio wave information.

4. The information processing apparatus according to claim 1, wherein the control circuitry learns a range of daily activities of the user on a basis of the newly acquired radio wave information, and in a case where an existing position of the user is not included in the range of daily activities of the user and the radio wave information corresponding to the candidate for the suspicious-person radio wave information is detected, records the candidate for the suspicious-person radio wave information as the new suspicious-person radio wave information.

5. The information processing apparatus according to claim 1, wherein in a case where an existing position of the user is changing at a speed of a predetermined threshold value or higher, the control circuitry determines that the user is moving in a vehicle, and stops recording the suspicious-person radio wave information.

6. The information processing apparatus according to claim 1, wherein the control circuitry ranks the suspicious-person radio wave information in accordance with at least one of a detection status of the suspicious-person radio wave information and an evaluation result of the suspicious-person radio wave information performed by the user, and controls timing of the warning in accordance with ranking of the suspicious-person radio wave information.

7. The information processing apparatus according to claim 1, wherein further utilizing information registered on a network, the control circuitry analyzes the candidate for the suspicious-person radio wave information and the suspicious-person radio wave information.

8. The information processing apparatus according to claim 1, wherein the control circuitry causes a detection status of at least one of the candidate for the suspicious-person radio wave information and the suspicious-person radio wave information to be displayed in a time line or on a map utilizing the related information associated with the information.

9. The information processing apparatus according to claim 1, wherein the radio wave is a radio wave emitted from an imaging device installed at a predetermined position or a communication appliance associated in advance with the imaging device and detected by the imaging device or the communication appliance, data concerning a captured image generated by the imaging device installed at the predetermined position is stored in a predetermined storage location in association with a time stamp concerning the captured image, and the control circuitry compares the newly acquired radio wave information and the recorded radio wave information to analyze whether the newly acquired radio wave information has already been recorded, and in a case where the newly acquired radio wave information has not been recorded, records the newly acquired radio wave information as the related information in association with information concerning a time stamp of the radio wave information, and refers to the information concerning the time stamp associated with the newly recorded radio wave information to specify data concerning the captured image corresponding to a designated time stamp from data concerning the captured image stored in the predetermined storage location, and provides the user with information concerning the specified captured image.

10. The information processing apparatus according to claim 9, wherein the control circuitry causes a time stamp of the newly recorded radio wave information corresponding to the captured image and a thumbnail image concerning the captured image to be displayed on a display screen as information concerning the captured image.

11. The information processing apparatus according to claim 10, wherein the control circuitry generates, as the display screen, a specified result display area in which a result of specifying the captured images is to be displayed and a captured image display area in which the captured image designated by a user operation among the specified captured images is to be displayed, and causes a display object representing a temporal position of a time stamp of the newly added radio wave information, a thumbnail image of the captured image corresponding to the time stamp of the newly added radio wave information, and a display object representing a temporal position of a time stamp of the captured image displayed in the captured image display area to be displayed in the specified result display area.

12. The information processing apparatus according to claim 1, wherein the radio wave is a radio wave utilized in wireless communication.

13. The information processing apparatus according to claim 1, further comprising:

a radio wave detection circuitry configured to acquire the radio wave information.

14. An information processing apparatus comprising:

a control circuitry configured to control processing of recording radio wave information concerning a radio wave observed in a predetermined environment and related information related to the radio wave information in association with each other, comparing the newly acquired radio wave information and the recorded radio wave information, and in a case where a result of comparison satisfies a predetermined condition, providing a user with a predetermined function on a basis of related information related to the newly acquired radio wave information, wherein the radio wave is a home radio wave emitted from an electronic appliance of a communication appliance installed in a house of the user or an electronic appliance or a communication appliance held by the user, the recorded radio wave information is obtained by associating home radio wave information concerning the home radio wave with information concerning a time stamp at which the home radio wave information is acquired as the related information, and the control circuitry associates the newly acquired radio wave information and the home radio wave information, and analyzes whether the newly acquired radio wave information is the home radio wave information, and in a case where predetermined all pieces of the home radio wave information are not detected within a predetermined period, operates a system configured to manage the house.

15. The information processing apparatus according to claim 14, wherein the control circuitry, in a case where the newly acquired radio wave information is not the home radio wave information, selects the newly acquired radio wave information as a candidate for the home radio wave information to be added, and in a case where the radio wave information corresponding to the candidate for the home radio wave information satisfies a predetermined condition within a predetermined period, records the radio wave information corresponding to the candidate for the home radio wave information as the new home radio wave information.

16. The information processing apparatus according to claim 14, wherein the control circuitry machine-learns a life pattern of the user on a basis of the detected home radio wave information, and operates a predetermined function of the system configured to manage the house on a basis of a learning result of the life pattern of the user.

17. The information processing apparatus according to claim 14, wherein the system configured to manage the house is at least one of a security system for the house and an energy management system for the house.

18. An information processing method comprising:

controlling processing of recording radio wave information concerning a radio wave observed in a predetermined environment and related information related to the radio wave information in association with each other, comparing the newly acquired radio wave information and the recorded radio wave information, and in a case where a result of comparison satisfies a predetermined condition, providing a user with a predetermined function on a basis of related information related to the newly acquired radio wave information;

wherein the radio wave is a radio wave emitted around an electronic appliance or a communication appliance held by the user, obtaining the recorded radio wave information by associating the radio wave information acquired from a range of daily activities of the user with at least one of positional information showing a position where the radio wave information is acquired as the related information and information concerning a time stamp at which the radio wave information is acquired, and in a case where the newly acquired radio wave information is not the recorded radio wave information, recording the newly acquired radio wave information as a candidate for suspicious-person radio wave information which is the radio wave information emitted from an electronic appliance or a communication appliance held by a suspicious person, and in a case where the recorded candidate for the suspicious-person radio wave information is detected as satisfying a predetermined condition, recording the candidate for suspicious-person radio wave information that satisfies the predetermined condition as the new suspicious-person radio wave information, and in a case where the newly acquired radio wave information is radio wave information corresponding to the suspicious-person radio wave information, issuing a warning to the user.

19. An information processing method comprising:

controlling processing of recording radio wave information concerning a radio wave observed in a predetermined environment and related information related to the radio wave information in association with each other, comparing the newly acquired radio wave information and the recorded radio wave information, and in a case where a result of comparison satisfies a predetermined condition, providing a user with a predetermined function on a basis of related information related to the newly acquired radio wave information;

wherein the radio wave is a home radio wave emitted from an electronic appliance of a communication appliance installed in a house of the user or an electronic appliance or a communication appliance held by the user, obtaining the recorded radio wave information by associating home radio wave information concerning the home radio wave with information concerning a time stamp at which the home radio wave information is acquired as the related information, and associating the newly acquired radio wave information and the home radio wave information, and analyzing whether the newly acquired radio wave information is the home radio wave information, and in a case where predetermined all pieces of the home radio wave information are not detected within a predetermined period, operating a system configured to manage the house.

* * * * *